US012624488B2

(12) United States Patent
Lee et al.

(10) Patent No.: US 12,624,488 B2
(45) Date of Patent: May 12, 2026

(54) ELECTRONIC APPARATUS AND SENSOR BALL REGISTRATION METHOD OF ELECTRONIC APPARATUS

(71) Applicant: SAMSUNG ELECTRONICS CO., LTD., Suwon-si (KR)

(72) Inventors: Kyungwoo Lee, Suwon-si (KR); Taedong Goh, Suwon-si (KR); Daehyun Kim, Suwon-si (KR); Youngjun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 223 days.

(21) Appl. No.: 18/311,559

(22) Filed: May 3, 2023

(65) Prior Publication Data

US 2023/0313433 A1 Oct. 5, 2023

Related U.S. Application Data

(63) Continuation of application No. PCT/KR2021/016883, filed on Nov. 17, 2021.

(30) Foreign Application Priority Data

Dec. 8, 2020 (KR) ..... 10-2020-0170732

(51) Int. Cl.
*D06F 34/26* (2020.01)
*D06F 34/05* (2020.01)
*D06F 34/28* (2020.01)

(52) U.S. Cl.
CPC ..... *D06F 34/05* (2020.02); *D06F 34/26* (2020.02); *D06F 34/28* (2020.02)

(58) Field of Classification Search
CPC ..... D06F 34/05; D06F 34/26; D06F 34/28
See application file for complete search history.

(56) References Cited

U.S. PATENT DOCUMENTS 10,808,351 B1 10/2020 Flachsbart et al.
2003/0179746 A1 9/2003 Moon et al.
(Continued)

FOREIGN PATENT DOCUMENTS

CN 1464925 A 12/2003
CN 103839023 A 6/2014
(Continued)

OTHER PUBLICATIONS

Machine translation of KR 20140022673 A, dated Feb. 25, 2014. (Year: 2014).*
(Continued)

*Primary Examiner* — Joseph L. Perrin
*Assistant Examiner* — Kevin G Lee
(74) *Attorney, Agent, or Firm* — Nixon & Vanderhye P.C.

(57) ABSTRACT

Provided are an electronic apparatus and a sensor ball registration method of the electronic apparatus. The electronic apparatus according to examples of the present disclosure comprises: a communication circuit; a display; an actuator; a speaker; and a controller electrically connected to the communication circuit, the display, the actuator, and the speaker. The controller may be configured to: control so that a first guidance message is output through the display or the speaker in accordance with a sensor ball registration mode selection input; check sensor ball identification information included in a sensor ball-related message received through the communication circuit during a set period of time; control so that a second guidance message is output through the display or the speaker based on the set period of time expiring; and control so that, after the set period of time has expired, the sensor ball corresponding to the sensor ball-related message received during the set period of time is registered based on at least one sensor ball-related message received from the sensor ball.

19 Claims, 19 Drawing Sheets

(56) References Cited

U.S. PATENT DOCUMENTS

| | | | |
|---|---|---|---|
| 2003/0227394 | A1 | 12/2003 | Rothgeb et al. |
| 2013/0222115 | A1 | 8/2013 | Davoodi et al. |
| 2014/0141721 | A1 | 5/2014 | Kim et al. |
| 2015/0256402 | A1 | 9/2015 | Choi et al. |
| 2017/0067201 | A1 | 3/2017 | Jeon et al. |
| 2017/0339731 | A1 | 11/2017 | Vankieken |
| 2020/0181824 | A1 | 6/2020 | Vitali |
| 2020/0374604 | A1 | 11/2020 | Park et al. |
| 2021/0002810 | A1 | 1/2021 | Kessler et al. |
| 2021/0409924 | A1 | 12/2021 | Lim et al. |

FOREIGN PATENT DOCUMENTS

| | | | |
|---|---|---|---|
| CN | 105252971 | A | 1/2016 |
| CN | 111819320 | A | 10/2020 |
| EP | 3628769 | A1 | 4/2020 |
| JP | 2018143646 | | 9/2018 |
| KR | 20080004694 | A | 1/2008 |
| KR | 20140022673 | A | 2/2014 |
| KR | 20160039872 | A | 4/2016 |
| KR | 101862515 | B1 | 5/2018 |
| KR | 101939089 | B1 | 1/2019 |
| KR | 20200082342 | A | 7/2020 |
| KR | 20200135122 | A | 12/2020 |
| WO | 2007/004173 | | 1/2007 |
| WO | 2019/203443 | | 10/2019 |
| WO | 2020/167067 | | 8/2020 |

OTHER PUBLICATIONS

Machine translation of KR 20200135122 A, dated Dec. 2, 2020. (Year: 2020).*

Extended European Search Report dated Feb. 16, 2024 issued in European Patent Application No. 21903664.7.

International Search Report for PCT/KR2021/016883 mailed Feb. 25, 2022, 3 pages.

Written Opinion of the ISA for PCT/KR2021/016883 mailed Feb. 25, 2022, 4 pages.

European Office Action dated Apr. 9, 2025 for EP Application No. 21903664.7.

Chinese Office Action dated May 22, 2025 for CN Application No. 202180082227.3.

* cited by examiner

ELECTRONIC APPARATUS AND SENSOR BALL REGISTRATION METHOD OF ELECTRONIC APPARATUS

CROSS-REFERENCE TO RELATED APPLICATIONS

This application is a continuation of International Application No. PCT/KR2021/016883 designating the United States, filed on Nov. 17, 2021, in the Korean Intellectual Property Receiving Office and claiming priority to Korean Patent Application No. 10-2020-0170732, filed on Dec. 8, 2020, in the Korean Intellectual Property Office, the disclosures of which are incorporated by reference herein in their entireties.

BACKGROUND

Field

The disclosure relates to an electronic device and a sensor ball registration method of the electronic device.

Description of Related Art

A sensor device that acquires a sensing value related to the operation of an electronic device is widely spread. For example, a washing machine may include a door sensor for determining that a door is closed before the washing machine starts to operate, and a water level sensor capable of detecting the height of water level to maintain an appropriate water level for washing. Also, a dryer with a built-in humidity sensor may determine whether laundry has been sufficiently dried, based on a humidity value acquired from the humidity sensor.

A sensor device for acquiring a sensing value related to an operation of an electronic device may be embedded in the electronic device as a part of the electronic device or integrally combined with the electronic device. It may be difficult for the sensor device embedded in the electronic device to acquire a sensing value at a location away from the surface of the electronic device. For example, in the case of a dryer with a built-in humidity sensor, even when the humidity sensor is disposed closest to laundry, the humidity sensor is located on the inner surface of the dryer, and thus may not acquire a humidity value of laundry away from the inner surface of the dryer. Therefore, a sensing value detected by the sensor device may be different from a sensing value that is actually required.

A sensor device may be a device (e.g., a sensor ball) that is not embedded in the electronic device and is distinct from the electronic device. For example, as the sensor device moves in the electronic device, the sensor device may generate electrical energy through an energy harvester, and may transmit a sensing value acquired through a sensor to the electronic device.

A movable sensor device (e.g., a sensor ball) configured separately from an electronic device must be registered in the electronic device (e.g., a washing machine or a dryer) so that information received from the sensor device can be distinguished from information received from other sensor devices. For example, when the sensor device broadcasts the sensed information by Bluetooth low energy (BLE) advertising, the electronic device (e.g., a washing machine or a dryer) must collect information from the registered sensor device or a sensor device operating in the electronic device to prevent confusion with information acquired from other sensor devices (e.g., other adjacent sensor devices).

SUMMARY

Embodiments of the disclosure may provide an electronic device and a sensor ball registration method of the electronic device, wherein without directly registering information about a specific sensor device (e.g., a specific sensor ball) in the electronic device, a user may intuitively and easily register the sensor device.

An electronic device according to an example embodiment may include: a communication circuit, a display, an actuator, a speaker, and a controller electrically connected to the communication circuit, the display, the actuator, and the speaker, wherein the controller is configured to: control the display or the speaker to output a first guidance message in response to a selection input of a sensor ball registration mode, identify identification information of a sensor ball included in a sensor ball-related message received through the communication circuit for a specified time, control the display or the speaker to output a second guidance message based on the specified time expiring, and based on the specified time expiring, perform control to register a sensor ball corresponding to the sensor ball-related message received for the specified time, based on at least one sensor ball-related message received from the sensor ball.

An electronic device according to various example embodiments may include: a communication circuit, a display, an actuator, a speaker, and a controller electrically connected to the communication circuit, the display, the actuator, and the speaker, wherein the controller is configured to: control the actuator to be driven during a specified first operation interval, identify identification information of a sensor ball included in a sensor ball-related message received through the communication circuit during the specified first operation interval, control the actuator to be stopped during a specified first stop interval based on the specified first operation interval elapsing, and perform control to register, based on at least one sensor ball-related message received from the sensor ball, a sensor ball corresponding to the sensor ball-related message received for the specified time based on the specified first stop interval elapsing.

A sensor ball registration method of an electronic device, according to various example embodiments, may include: outputting a first guidance message through a display or a speaker in response to a selection input of a sensor ball registration mode, identifying identification information of a sensor ball included in a sensor ball-related message received through a communication circuit for a specified time, outputting a second guidance message through the display or the speaker based on the specified time expiring, and based on the specified time expiring, registering a sensor ball corresponding to the sensor ball-related message received for the specified time, based on at least one sensor ball-related message received from the sensor ball.

A sensor ball registration method of an electronic device, according to various example embodiments, may include: controlling the actuator included in the electronic device to be driven during a specified first operation interval, identifying identification information of a sensor ball included in a sensor ball-related message received through a communication circuit during the specified first operation interval, controlling the actuator to be stopped during a specified first stop interval based on the specified first operation interval elapsing, and registering, based on at least one sensor ball-related message received from the sensor ball, a sensor ball corresponding to the sensor ball-related message received for the specified time based on the specified first stop interval elapsing.

An electronic device and a sensor ball registration method of the electronic device, according to various example embodiments, enable a user intuitively and easily register a specific sensor device (e.g., a specific sensor ball) without directly registering information about the sensor device in the electronic device.

According to a sensor device registration method according to various example embodiments, it is possible to filter information received from a sensor device operating in another electronic device other than a corresponding electronic device.

BRIEF DESCRIPTION OF THE DRAWINGS

The above and other aspects, features and advantages of certain embodiments of the disclosure will be more apparent from the following detailed description, taken in conjunction with the accompanying drawings, in which.

DETAILED DESCRIPTION

Figure 1:
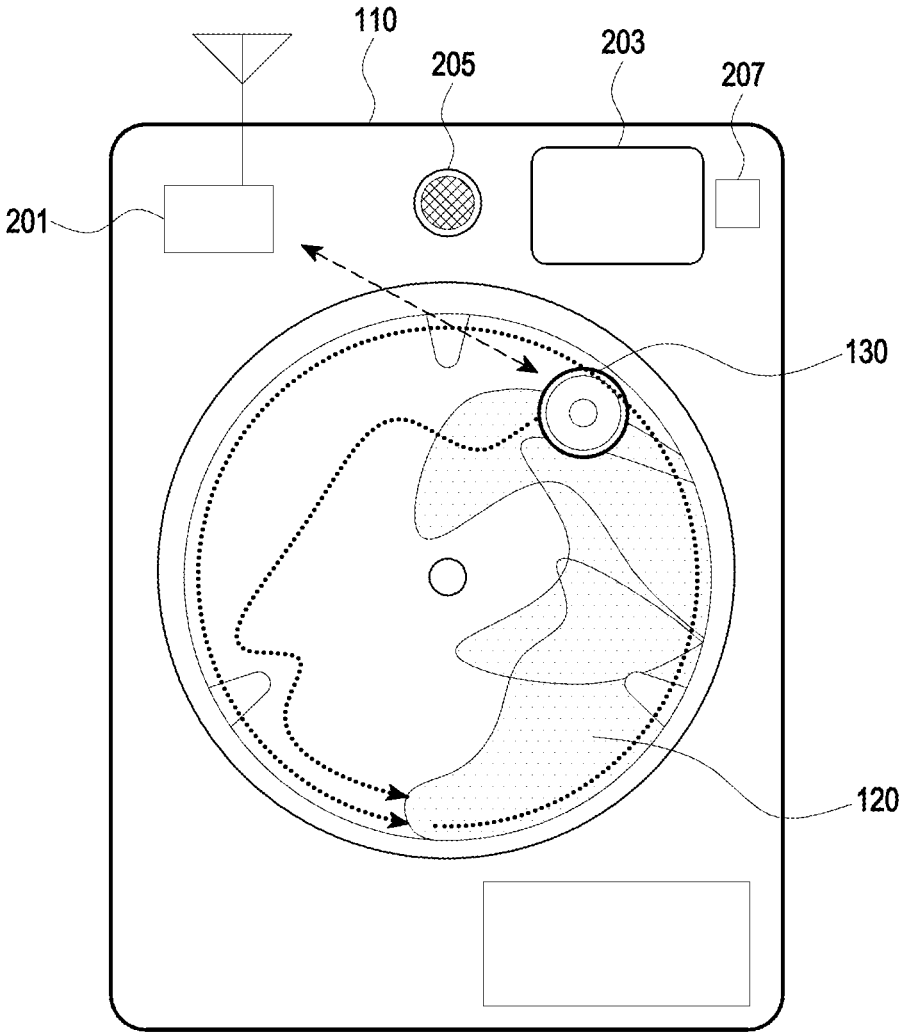
FIG. 1 is a diagram illustrating an example in which an electronic device and a sensor ball are utilized according to various embodiments.

FIG. 1 is a diagram illustrating an example in which an electronic device and a sensor ball are utilized according to various embodiments. In FIG. 1, an electronic device 110 may be a washing machine or a dryer, but is not limited thereto. For example, the electronic device 110 may include a communication circuit 201 therein. In addition, in the electronic device 110, a display 203, a speaker 205, and an input module (e.g., including input circuitry) 207 may be disposed in the housing, or outside or inside of the housing of the electronic device. The electronic device 110 may accommodate laundry 120 and a sensor ball 130 (e.g., a sensor device or an electronic device) therein. In the following description, the sensor ball 130 is used as a generic term for a movable electronic device or sensor device including at least one sensor, and is not a term used to limit the sensor ball to a specific form.

The sensor ball 130 may be located in the laundry 120. According to various embodiments, after the operation of the electronic device 110 (e.g., driving of an actuator) starts, the sensor ball 130 may acquire a sensing value in the laundry 120. For example, the sensor ball 130 can freely move in the electronic device 110 according to the operation of the electronic device 110 (e.g., rotation of the inner tub of a washing machine). The sensor ball 130 may generate electrical energy by converting, into electrical energy, energy generated when the sensor ball 130 freely is moved by the operation of the electronic device 110. The sensor ball 130 may store the generated electrical energy in an energy storage circuit (e.g., an energy storage circuit (e.g., a capacitor) in an energy harvesting module). According to various embodiments, when the actuator of the electronic device 110 is driven, the sensor ball 130 may freely move in the electronic device 110. In this case, a magnet provided in the sensor ball 130 may be moved, and induced electromotive force may be generated according to the movement of the magnet. The sensor ball 130 may convert various types of energy (kinetic energy, thermal energy, and light energy) from the electronic device 110 as described above or an external environment into electrical energy.

According to various embodiments, the sensor ball 130 may drive at least one sensor or controller (or processor) in the sensor ball 130 by the generated electrical energy. The sensor ball 130 may transmit various types of data sensed by the sensor to the electronic device 110 through a communication circuit (or communication module) (e.g., BLE module) included in the sensor ball 130. For example, the sensor ball 130 may include a sensor driven by energy stored in an energy storage circuit, and may acquire a sensing value through the sensor included in the sensor ball 130. According to various embodiments, the sensor ball 130 may transmit a measured value (e.g., a voltage or a current) and/or a sensing value of the energy storage circuit to the electronic device 110. The electronic device 110 may check the weight or volume of the laundry 120 based on the measured value (e.g., voltage or current) and/or the sensing value of the energy storage circuit received from the sensor ball 130. According to various embodiments, the electronic device 110 may control the actuator based on at least one among the weight of the laundry 120, the volume of the laundry 120, and the sensing value.

Figure 2A:
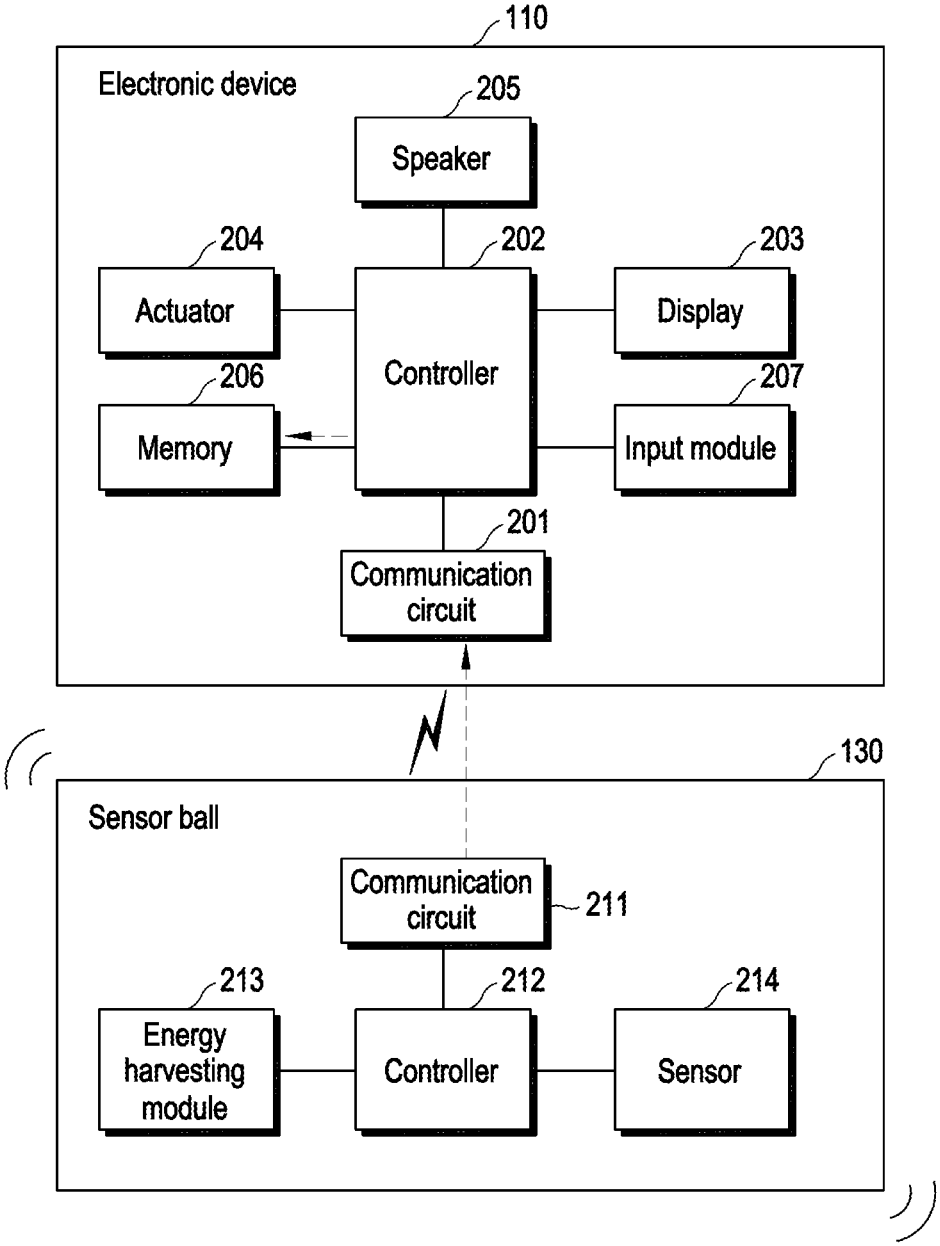
FIG. 2A is a block diagram illustrating an example configuration of an electronic device and a sensor ball according to various embodiments.

FIG. 2A is a block diagram illustrating an example configuration of an electronic device and a sensor ball according to various embodiments. Referring to FIG. 2A, an electronic device 110 (e.g., a washing machine or a dryer) may include a communication circuit 201, a controller (e.g., including control and/or processing circuitry) 202 (or a processor), a display 203, an actuator 204, a speaker 205, a memory 206, and/or an input module (e.g., including input circuitry) 207. A sensor ball 130 may include a communication circuit 211, a controller (e.g., including control and/or processing circuitry) 212 (or a processor), an energy harvesting module (e.g., including various circuitry) 213, and/or at least one sensor 214.

According to various embodiments, the controller 202 of the electronic device 110 may be a single controller or multiple controllers. The controller 202 may, for example, include various processing and/or control circuitry and execute software to control at least one other component (e.g., hardware or software component) of the electronic device 110, and may perform various types of data processing or calculation. According to an embodiment, as at least part of data processing or calculation, the controller 202 may load a command or data received from another element (e.g., the communication circuit 201) in a volatile memory, may process the command or data stored in the volatile memory, and may store result data in a non-volatile memory. According to an embodiment, the controller 202 may include a main controller (e.g., a central processing unit or application controller), and an auxiliary controller (e.g., a graphics processing unit, an image signal controller, a sensor hub controller, or a communication controller) that can operate independently of or in conjunction with the main controller. Additionally or alternatively, the auxiliary controller may be configured to use lower power than the main controller or to be specialized for a designated function.

According to various embodiments, the communication circuit 201 may be used to receive, from the sensor ball 130, information indicating the voltage of the energy harvesting module acquired by the sensor ball 130 or information (e.g., humidity or temperature) sensed by the at least one sensor 214 in the sensor ball. According to various embodiments, the communication circuit 201 may perform Bluetooth low energy (BLE), Bluetooth, Zigbee, Wi-Fi, or infrared (IR) communication. Hereinafter, in an embodiment, an example of the communication circuit 201 is described as BLE, but various embodiments are not limited thereto. According to various embodiments, the communication circuit 201 may be implemented on the same chip together with the controller 202.

The communication circuit 201 may support establishment of a wireless communication channel between the electronic device 110 and an external electronic device (e.g., the sensor ball 130), and communication via the established communication channel. The communication circuit 201 may include one or more communication controllers that operate independently of the controller 202 (e.g., an application processor) and support wireless communication. According to an embodiment, the communication circuit 201 may include a wireless communication circuit (e.g., a cellular communication circuit, a short-range wireless communication circuit, or a global navigation satellite system (GNSS) communication circuit). A corresponding communication circuit among these communication circuits may communicate with an external electronic device through a first network (e.g., a short-range communication network such as Bluetooth, WiFi direct, or infrared data association (IrDA)) or a second network (e.g., a long-range communication network such as a cellular network, the Internet, or a computer network (e.g., a LAN or WAN)). These various types of communication circuits may be integrated into one element (e.g., a single chip) or implemented as multiple separate elements (e.g., multiple chips). The wireless communication circuit may identify and authenticate the sensor ball 130 within a communication network such as the first network or the second network using subscriber information (e.g., International Mobile Subscriber Identity (IMSI)) stored in a subscriber identification module.

The memory 206 may store various types of data to be used by at least one element (e.g., the controller 202) of the electronic device 110. The data may include, for example, input data or output data about software (e.g., a program) and commands related thereto. The memory 206 may include volatile memory or non-volatile memory. According to various embodiments, the memory 206 may be implemented on the same chip together with the controller 202 or the communication circuit 201.

According to various embodiments, the memory 206 may store identification information (e.g., universally unique identifier (UUID)) of the sensor ball 130 registered in the electronic device 110. The controller 202 may check the weight or volume of the laundry 130 based on a voltage of the energy harvesting module included in the sensor ball 130, the voltage being received through the communication circuit 201. Also, the controller 202 may control the actuator 204 based on at least one of the checked weight or volume of the laundry 130 or the sensing value.

According to various embodiments, the actuator 204 may generate a dynamic movement using an electrical signal received from the controller 202. According to various embodiments, the electronic device 110 may be a dryer or a washing machine, and the actuator 204 may include a motor embedded in the electronic device 110.

According to various embodiments, the sensor ball 130 may include the communication circuit 211, the controller 212, the energy harvesting module 213, and the at least one sensor 214. The sensor ball 130 may further include at least one of a rectifier circuit, an energy storage circuit, a switch, a protection circuit, a DC/DC converter, and a monitoring circuit, which will be described in greater detail below with reference to FIG. 6.

According to various embodiments, the energy harvesting module 213 may convert energy other than electrical energy into electrical energy. According to various embodiments, the energy harvesting module 213 may include a magnetic field induction-type harvester. According to various embodiments, the energy harvesting module 213 may further include at least one of a piezoelectric harvester, a thermoelectric harvester, a triboelectric harvester, a photoelectric harvester, an RF harvester, or a vibration energy harvesting module. The structure of the magnetic field induction-type harvester will be described in greater detail below with reference to FIGS. 3D and 3E.

According to various embodiments, the energy harvesting module 213 of the sensor ball 130 may convert alternating-current electrical energy generated in the energy harvester into direct-current electrical energy through a rectifier circuit. Depending on the implementation, the voltage and/or current of rectified electrical energy may be adjusted and output through an additional circuit (e.g., a regulator).

According to various embodiments, the energy harvesting module 213 of the sensor ball 130 may store the direct-current electrical energy through an energy storage circuit. According to various embodiments, the energy storage circuit may include at least one of a battery, a capacitor, or a supercapacitor. According to various embodiments, when the energy storage circuit includes a battery, the energy storage circuit may further include a capacitor for rectifying a current input into the battery. According to various embodiments, when the energy storage circuit includes a battery, the energy storage circuit may further include an integrated circuit (IC) or a power management integrated circuit (PMIC) for charging the battery.

According to various embodiments, the sensor ball 130 may include the controller 212. According to various embodiments, the controller 212 may be a single controller or multiple controllers. The controller 212 may, for example, include various control and/or processing circuitry and execute software to control at least one other element (e.g., hardware or software element) of the sensor ball 130, and may perform various types of data processing or calculation. According to an embodiment, as at least part of data processing or operation, the controller 212 may load commands or data received from another element (e.g., the sensor 214 or the communication circuit 211) in volatile memory, may process the commands or data stored in the volatile memory, and may store result data in non-volatile memory. According to an embodiment, the controller 212 may include a main controller (e.g., a central processing unit or an application controller), and an auxiliary controller (e.g., a graphics processing unit, an image signal controller, a sensor hub controller, or a communication controller) operable independently of or in conjunction with the main controller. Additionally or alternatively, the auxiliary controller may be configured to use lower power than the main controller or to be specialized for a designated function.

According to various embodiments, the sensor ball 130 may check the voltage of energy stored through the energy harvesting module 213. According to various embodiments, the at least one sensor 214 may sense an external environment state of the sensor ball 130 and may generate an electrical signal or data value corresponding to the sensed state. According to various embodiments, the sensor 214 may include at least one of, for example, a temperature sensor, a humidity sensor, an acceleration sensor, a gyro sensor, a detergent amount sensor, or a turbidity sensor. For example, the detergent amount sensor may include a pair of electrodes for measuring electrical conductivity in washing water, and may detect the amount of detergent through the electrical conductivity of the washing water, which varies according to the amount of detergent dissolved. For example, the turbidity sensor may detect turbidity by measuring the transmittance and scattering rate of light that change depending on the amount of particles dissolved in water For example, the sensor 214 may include at least one among a temperature sensor, a humidity sensor, an acceleration sensor, and a gyro sensor in order to generate a sensing value related to the operation of a washing machine or a dryer. In an embodiment, the sensor 214 may include one of a temperature sensor, a humidity sensor, an acceleration sensor, a gyro sensor, a detergent amount sensor, a pH sensor, an odor sensor, a contamination level sensor, or a turbidity sensor in order to generate a sensing value related to the operation of the washing machine. In an embodiment, the sensor 214 may include at least one of a temperature sensor, a humidity sensor, an acceleration sensor, and a gyro sensor in order to generate a sensing value related to the operation of the dryer, and may or may not include at least one of a detergent amount sensor, a pH sensor, a contamination level sensor, or a turbidity sensor.

According to various embodiments, the communication circuit 211 may be used to transmit a sensing value acquired through the sensor 214 and/or a signal indicating a voltage of an energy storage circuit to an electronic device (e.g., the electronic device 110). According to various embodiments, the communication circuit 211 may perform Bluetooth low energy (BLE), Bluetooth, Zigbee, Wi-Fi, and infrared (IR) communication. According to various embodiments, the communication circuit 211 may be implemented on the same chip together with the controller 212.

According to various embodiments, the sensor ball 130 may be registered in the electronic device 110, and the electronic device 110 may use only information received from the registered sensor ball 130 among multiple sensor balls 130.

Hereinafter, a procedure for registering the sensor ball 130 in the electronic device 110 according to various embodiments will be described in greater detail.

According to various embodiments, referring to FIG. 2A, selection of a sensor ball registration mode may be input while the power of the electronic device 110 (e.g., the washing machine or dryer) is turned on. For example, the sensor ball registration mode may be selected by a user through the input module 207 (e.g., a button) provided in the electronic device 110.

Figure 10A:
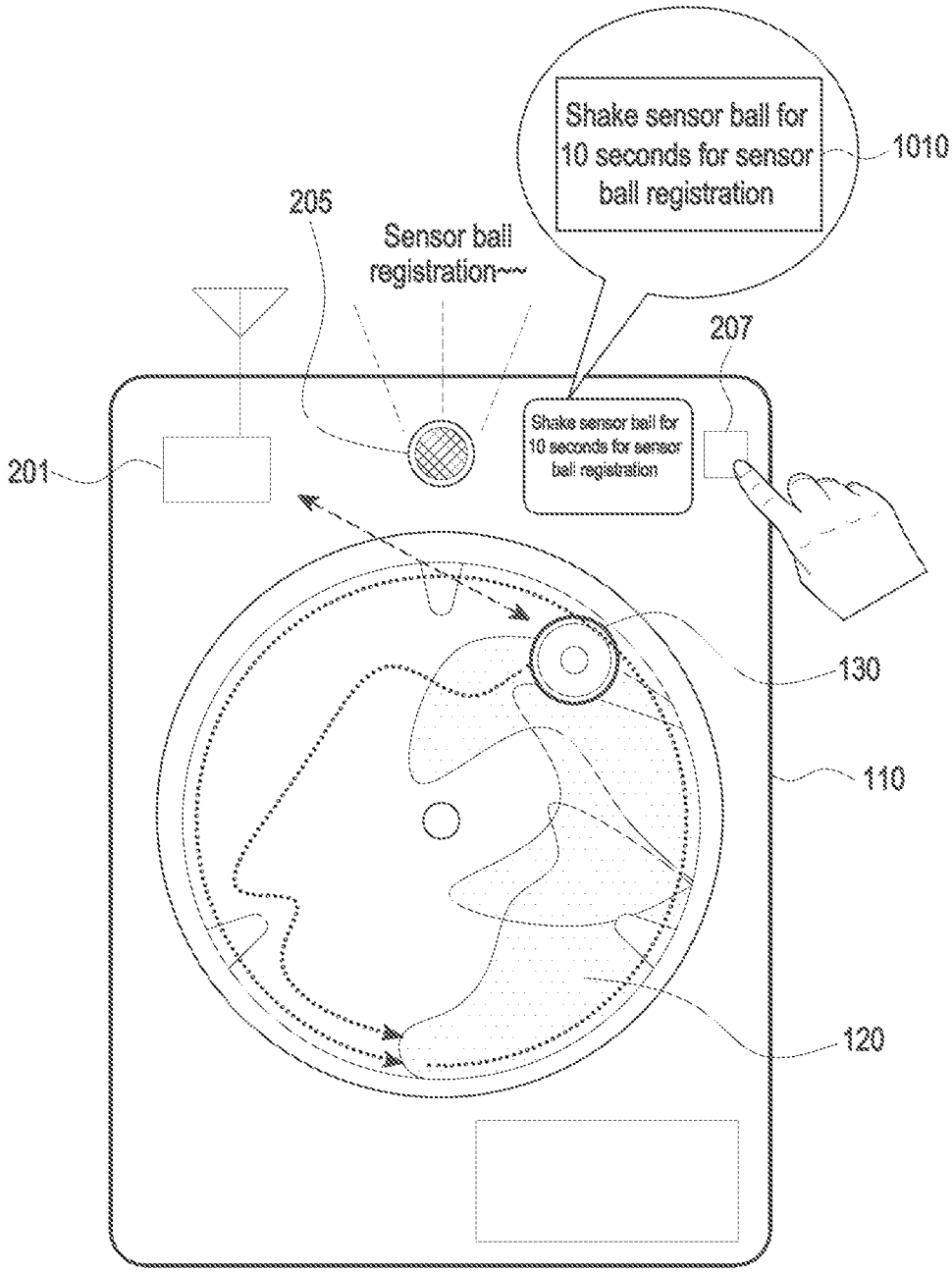
FIG. 10A is a diagram illustrating output of a guidance message in an electronic device according to various embodiments.

According to an embodiment, when the electronic device 110 operates for the first time or when there is no currently registered sensor ball, the sensor ball registration mode may induce registration of the sensor ball by automatically executing the sensor ball registration mode. Depending on the selection of the sensor ball registration mode, the controller 202 may generate a first guidance message. The first guidance message may include a guidance message related to shaking the sensor ball. According to various embodiments, as illustrated in FIG. 10A, the controller 202 may control the display 203 to display the generated first guidance message as a screen 1010 or may control the speaker 205 to output the first guidance message as voice. For example, the first guidance message may include a message inducing the user to shake a sensor ball, such as "Shake the sensor ball for 10 seconds to register the sensor ball for the first time" or "Shake the sensor ball for 10 seconds while pressing a sensor ball registration button to register the sensor ball for the first time". According to various embodiments, the controller 202 may drive a timer for a predetermined (e.g., specified) first time along with the output of the first guidance message.

According to various embodiments, when the user shakes the sensor ball 130 after checking the first information message, as described above, electrical energy is generated by the energy harvesting module 213 of the sensor ball 130, and the generated electrical energy may be stored in an energy storage circuit. When the user continues to shake the sensor ball 130, the voltage of the energy storage circuit of the sensor ball 130 may be continuously increased. The controller 212 of the sensor ball 130 may identify information about the voltage of the energy storage circuit, and may transmit the information about the voltage through the communication circuit 211. According to various embodiments, when the communication circuit 211 is a BLE module, the information about the voltage may be included in a BLE advertisement message and transmitted. The BLE advertisement message may include information (e.g., BLE service ID) indicating that the device having transmitted the message is a sensor ball and identification information (e.g., UUID) of the sensor ball. For example, the BLE advertisement message may be configured as shown in <Table 1> and <Table 2> below.

TABLE 1

| field | | | | | | size (byte) |
|---|---|---|---|---|---|---|
| | | pdu_header | | | pdu_type | 2 |
| | | | | | RFU | |
| | | | | | Chsel | |
| | | | | | TxAdd | |
| | | | | | RxAdd | |
| | | | | | pdu_length | |
| PDU Payload | | adv address (mac address) | | | | 6 |
| | AdvData | AdvData0 (Mandatory) | PDU data length | | | 1 |
| | | | PDU type | | | 1 |
| | | | PDU Data: flag | | | 1 |
| | | AdvData1 (Manufacture specific data) | BLE Advertisement Packet format | PDU data length | | 1 |
| | | | | PDU type | | 1 |
| | | | | company ID | | 2 |
| | | | | Control & Version | Multiple Services | 1 |
| | | | | | Active Scan | |
| | | | | | RFU | |
| | | | | | RFU | |
| | | | | | Version | |
| | | | | Service ID | | 1 |
| | | | device ID | | | 8 |
| | | | firmware ver | | | 2 |
| | | | Temperature | | | 2 |
| | | | Humidity | | | 2 |
| | | | reset flag | | | 1 |
| | | | Harvesting_Voltage | | | 2 |
| | | AdvData2 (Mandatory: local name | PDU data length | | | 1 |
| | | | PDU type | | | 1 |
| | | | local name | | | 3 |

TABLE 2

| field | | size (byte) | value | description |
|---|---|---|---|---|
| BLE Advertisement Packet format | PDU data length | 1 | 22 | data length |
| | PDU type | 1 | 0xff | manufacture specific data |
| | company ID | 2 | 0x0075 | Samsung Electronics Co.LTD |
| | Control & Version: Multiple Services | 1 | 0 | 1: Multiple services<br>0: Single service |
| | Active Scan | | 0 | 1: Active Scan Required<br>0: Passive Scan Required |
| | RFU | | 0 | |
| | RFU | | 0 | |
| | Version | | 0x2 | 0x2: AD Packet Ver. |
| | Service ID | 1 | 0x15 | 0x15: Smart Sensor Ball service ID |
| | device id | 8 | | Unique Device ID |
| | firmware ver | 2 | 0x0101 | ver: 1.1 |
| | Temperature | 2 | | Temperature data |
| | Humidity | 2 | | Humidity data |
| | reset flag | 1 | | 1: reset occurred0: normal case |
| | Harvesting_voltage | 2 | | Harvesting voltage data |

Referring to <Table 1> and <Table 2>, the BLE advertisement message may include at least one piece of advertisement data and/or a device ID. The device ID may be unique identification information (e.g., UUID) of an electronic device (e.g., the sensor ball 130) that transmits the BLE advertisement message.

According to various embodiments, specific advertisement data (e.g., AdvData1) may include information configured by a manufacturer of a specific product. Referring to <Table 2>, the advertisement data may include a PDU data length, a PDU type, a company ID, control and version information, and a service ID. The service ID may be identification information indicating that the device is a sensor ball. For example, the electronic device 110 having received the BLE advertisement message may identify the service ID included in the BLE advertisement message, and may determine that the type of electronic device that has transmitted the BLE advertisement message is the sensor ball 130. In addition, the electronic device 110 having received the BLE advertisement message may identify the device ID included in the BLE advertisement message, and may distinguish or identify an electronic device that has transmitted the BLE advertisement message.

According to various embodiments, the electronic device 110 may receive a BLE advertisement message transmitted from the sensor ball 130 through the communication circuit 201. The electronic device 110 may receive the BLE advertisement message once or twice or more within the predetermined first time, based on the driven timer. The controller 202 of the electronic device 110 may determine that the device that transmitted the BLE advertisement message is a sensor ball, from the information (e.g., a service ID) included in the BLE advertisement message. According to various embodiments, when the device that sent the BLE advertisement message is determined to be a sensor ball, the controller 202 of the electronic device 110 may identify identification information (e.g., a device ID (e.g., UUID)) of the sensor ball, and may store the identified identification information of the sensor ball in the memory 206. According to various embodiments, the controller 202 of the electronic device 110 may map voltage information included in the BLE advertisement message to the identification information of the sensor ball 130 and store the voltage information in the memory 206.

Figure 10B:
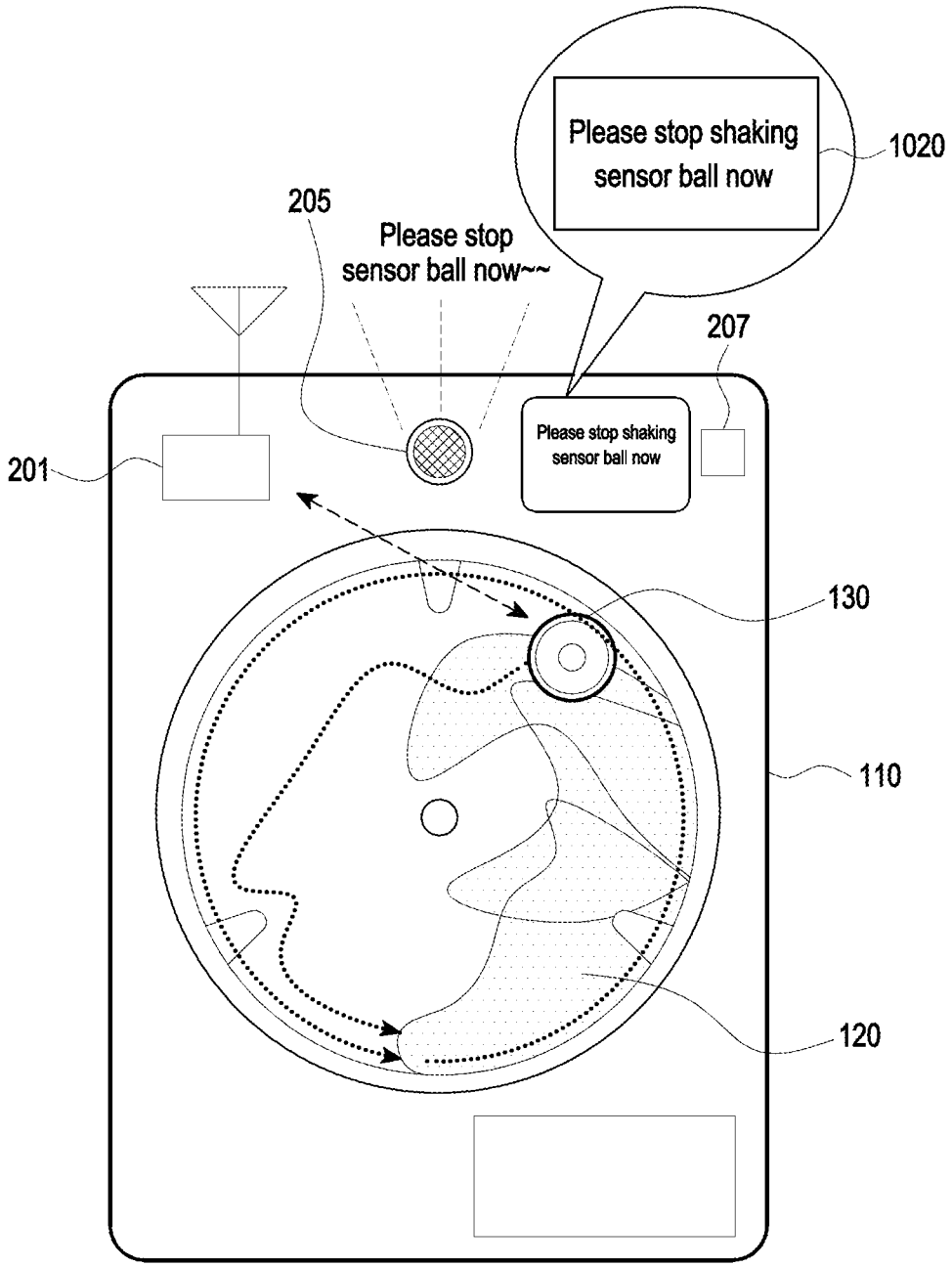
FIG. 10B is a diagram illustrating output of a guidance message in an electronic device according to various embodiments.

When it is determined that the predetermined first time has expired according to the driving of the timer, the controller 202 of the electronic device 110 may generate a second guidance message. The second guidance message may include a guidance message related to stopping shaking the sensor ball 130. According to various embodiments, as illustrated in FIG. 10B, the controller 202 may control the display 203 to display the generated second guidance message as a screen 1020 through or control the speaker 205 to output the second guidance message as voice. For example, the second guidance message may include a message for inducing the user to stop shaking the sensor ball 130, such as "Please stop shaking the sensor ball now". According to various embodiments, the controller 202 may stop and reset the driven timer along with the output of the second guidance message. When the user stops shaking the sensor ball 130 according to the second guidance message, the voltage of the energy storage circuit included in the sensor ball 130 may be reduced. When the voltage of the energy storage circuit is reduced, the sensor ball 130 may no longer transmit a BLE advertisement message or may transmit a BLE advertisement message including information about the reduced voltage.

According to various embodiments, the controller 202 of the electronic device 110 may determine whether a BLE advertisement message is received for a predetermined second time after outputting the second guidance message. The controller 202 of the electronic device 101 may register the sensor ball 130 corresponding to the BLE advertisement message received for the predetermined first time, based on whether the BLE advertisement message is received after outputting the second guidance message. For example, when it is determined that no additional BLE advertisement message is received for the predetermined second time, the controller 202 of the electronic device 110 may register the sensor ball 130 that has transmitted the BLE advertisement message received for the first time. The electronic device 110 may process the corresponding BLE advertisement message only when subsequently received BLE advertisement message includes identification information (e.g., UUID) of a sensor ball corresponding to the registered sensor ball 130. For example, the electronic device 110 may control operation of the electronic device 110 (e.g., driving of the actuator 204) based on various types of information included in the BLE advertisement message transmitted from the registered sensor ball 130.

According to an embodiment, the controller 202 of the electronic device 110 may identify voltage information included in a BLE advertisement message received for the predetermined second time, and may register the sensor ball 130 having transmitted the BLE advertisement message when the identified voltage is lower than a voltage identified through a previously received BLE advertisement message.

Figure 2B:
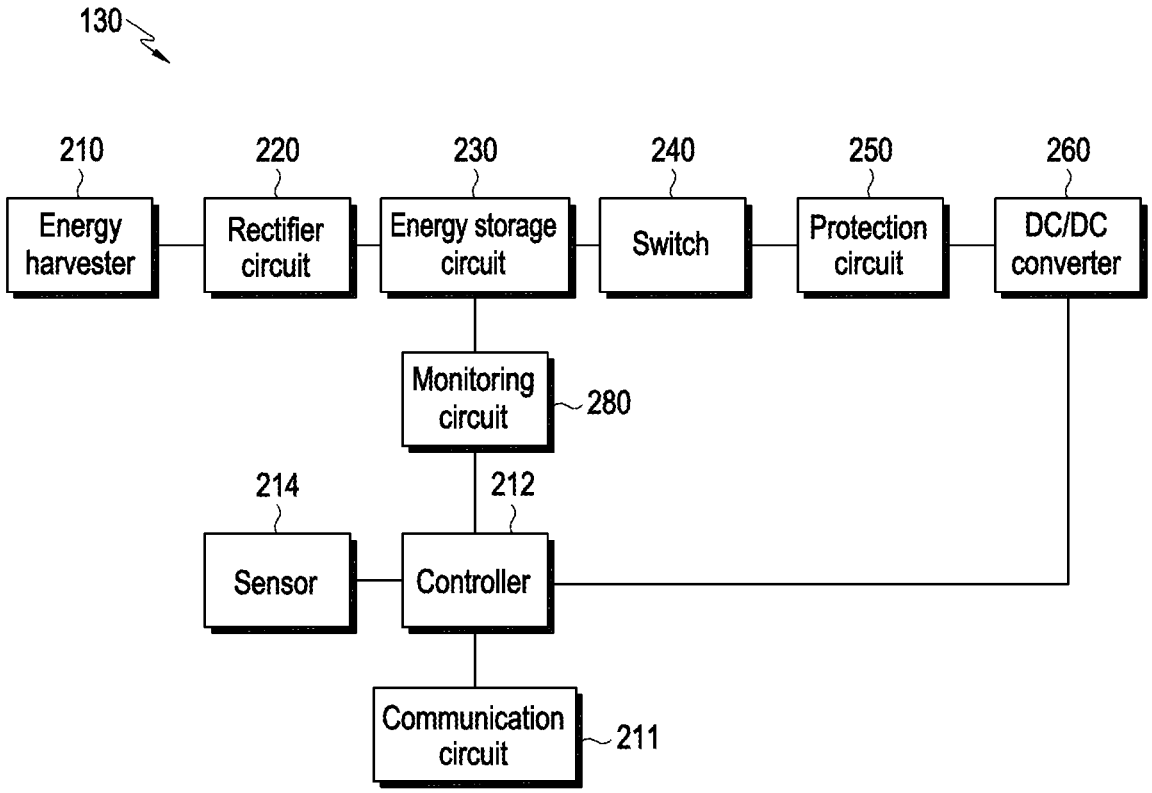
FIG. 2B is a block diagram illustrating an example configuration of a sensor ball according to various embodiments.

FIG. 2B is a block diagram illustrating an example configuration of a sensor ball according to various embodiments. Referring to FIG. 2B, a sensor ball 130 may include an energy harvester (e.g., including various circuitry) 210, a rectifier circuit 220, an energy storage circuit 230, a switch 240, a protection circuit 250, a DC/DC converter 260, a controller (e.g., including control and/or processing circuitry) 212, a monitoring circuit 280, a sensor 214, and a communication circuit 211. At least some elements among the energy harvester 210, the rectifier circuit 220, the energy storage circuit 230, the switch 240, the protection circuit 250, the DC/DC converter 260, and the monitoring circuit 280 may be included in the energy harvesting module 213 in FIG. 2A.

According to various embodiments, the energy harvester 210 may convert energy other than electrical energy into electrical energy. According to various embodiments, the energy harvester 210 may include a magnetic field induction-type harvester. According to various embodiments, the energy harvester 210 may further include at least one of a piezoelectric harvester, a thermoelectric harvester, a triboelectric harvester, a photoelectric harvester, an RF harvester, or a vibration energy harvester. The structure of the magnetic field induction-type harvester will be described in greater detail below with reference to FIGS. 3D and 3E. The piezoelectric harvester may include a piezoelectric element, and may generate electrical energy when an external mechanical force acts on the piezoelectric element. The thermoelectric harvester may include a thermoelectric element, and the thermoelectric element may convert thermal energy into electrical energy. The triboelectric harvester may include an electrode for absorbing electricity generated by friction. The photoelectric harvester may include a photoelectric element, and the photoelectric element may convert light energy into electrical energy. According to various embodiments, the photoelectric element may be disposed on the outer surface of the sensor ball 130. The RF harvester may include a wire for collecting electromagnetic waves. The vibration energy harvester may convert mechanical energy generated by vibration and/or rotation into electrical energy. The magnetic field induction-type harvester, the piezoelectric harvester, the thermoelectric harvester, the triboelectric harvester, the RF harvester, and the vibration energy harvester may generate electrical energy in the form of alternating current, and the photoelectric harvester may generate electrical energy in the form of direct current.

According to various embodiments, the rectifier circuit 220 may convert alternating-current electrical energy output from the energy harvester 210 into direct-current electrical energy. Depending on implementation, the rectifier circuit 220 may adjust and output the voltage and/or current of the rectified electrical energy.

According to various embodiments, the sensor ball 130 may include the energy storage circuit 230. The energy storage circuit 230 may be connected to an output terminal of the rectifier circuit 220 to store the direct-current electrical energy. According to various embodiments, the energy storage circuit 230 may include at least one of a battery, a capacitor, or a supercapacitor. According to various embodiments, when the energy storage circuit 230 includes a battery, the energy storage circuit 230 may further include a capacitor for rectifying a current that is input into the battery. According to various embodiments, when the energy storage circuit 230 includes a battery, the energy storage circuit 230 may further include an integrated circuit (IC) or a power management integrated circuit (PMIC) for charging the battery.

According to various embodiments, the switch 240 may be a hysteresis switch that will be described in greater detail below with reference to FIGS. 7B and 7C. According to various embodiments, the switch 240 may be a typical switch that has one reference voltage, does not output a voltage when an input voltage is less than the reference voltage, and outputs a voltage when an input voltage is greater than or equal to the reference voltage. The switch 240 may transmit or block the energy stored in the energy storage circuit 230 to the controller 212 via the protection circuit 250 and the DC/DC converter 260. According to various embodiments, the switch 240 may cut off supply of power to the controller 212 when an abnormal situation occurs or when an insufficient amount of electrical energy for the operation of the controller 212 or the sensor 290 is generated.

According to various embodiments, the protection circuit 250 may be connected to an input terminal of the switch 240 or an output terminal of the switch 240. According to various embodiments, the protection circuit 250 may include a Zener diode. According to various embodiments, the DC/DC converter 260 may convert a voltage of power transmitted through the switch 240 and the protection circuit 250 into a voltage to be used by the controller 212.

According to various embodiments, the monitoring circuit 280 may include a voltmeter and identify the voltage of the energy storage circuit 230. According to various embodiments, the monitoring circuit 280 may include an analog-to-digital converter (ADC) circuit. The monitoring circuit 280 may be connected to the controller 212, and may transmit information corresponding to the voltage of the energy storage circuit 230 to the controller 212.

Figure 3A:
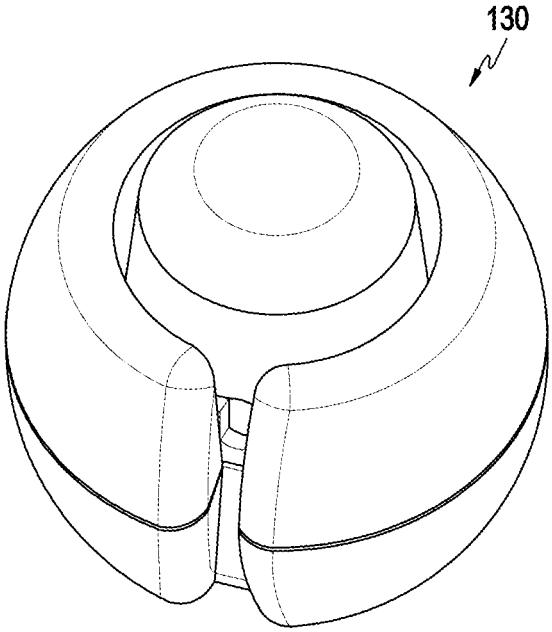
FIG. 3A is a perspective view illustrating a sensor ball according to various embodiments.

FIG. 3A is a perspective view illustrating a sensor ball according to various embodiments. Referring to FIG. 3A, the sensor ball 130 may have a shape similar to or identical to a sphere to facilitate free movement in the electronic device 110, but various embodiments are not limited thereto. The sensor ball 130 may form a ventilation window at least part of the spherical outside thereof.

Figure 3B:
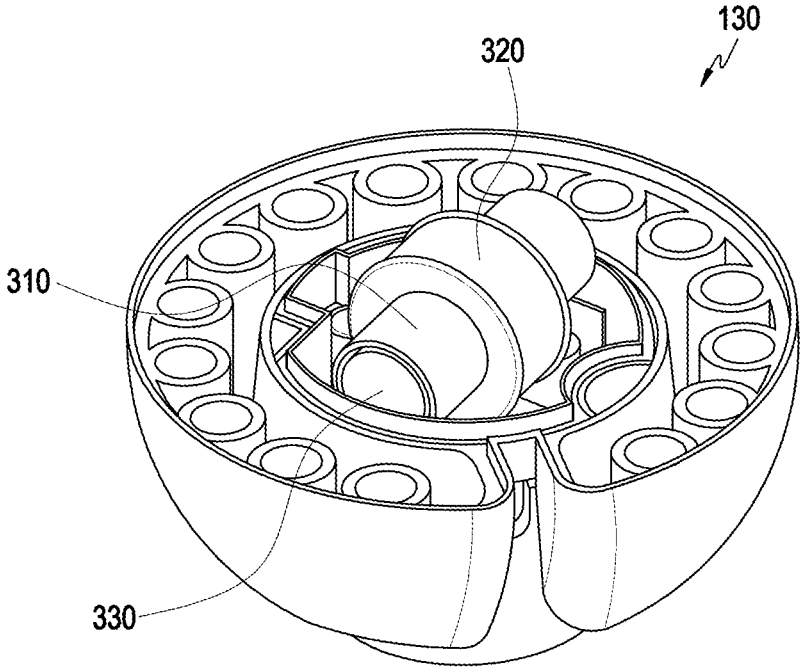
FIG. 3B is an internal perspective view of a sensor ball according to various embodiments.
Figure 3C:
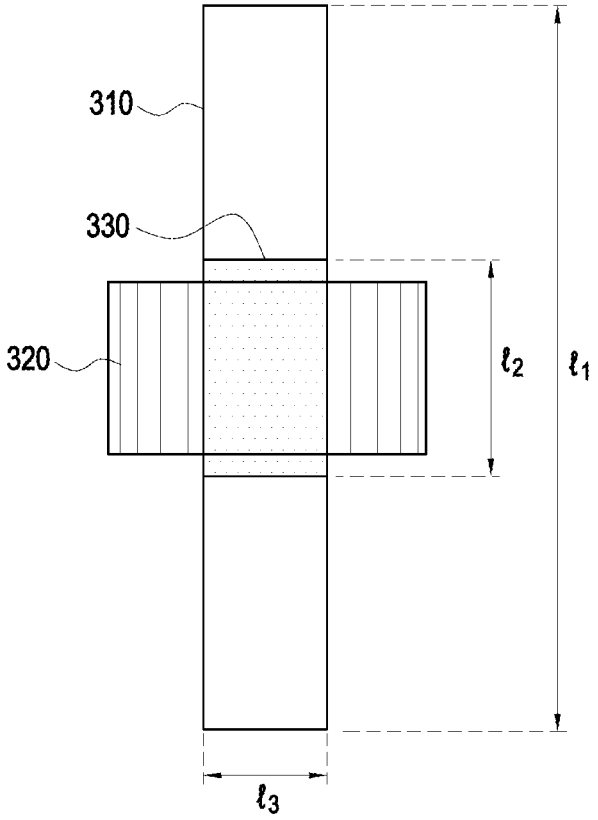
FIG. 3C is a diagram illustrating an energy harvester in a sensor ball according to various embodiments.

FIG. 3B is a diagram illustrating an internal perspective view of a sensor ball according to various embodiments. Referring to FIG. 3B, an energy harvester capable of collecting energy by the movement of the sensor ball 130 may be included inside the sensor ball 130. For example, the energy harvester included in the sensor ball 130 may include a guide 310 (e.g., a cylinder), a coil 320 wound around the guide, and a magnet 330 movably disposed in the guide. According to various embodiments, an induced electromotive force may be generated in the coil 320 by the movement of the magnet 300 in the guide 310. FIG. 3C is a diagram illustrating an energy harvester in a sensor ball according to various embodiments. Referring to FIG. 3C, the magnitude of the induced electromotive force generated in the coil 320 may vary depending on the length (1 of the guide 310, the length (2 of the magnet 330, the diameter (3 of the magnet 330, or the number of turns of the coil 320.

Figure 3D:
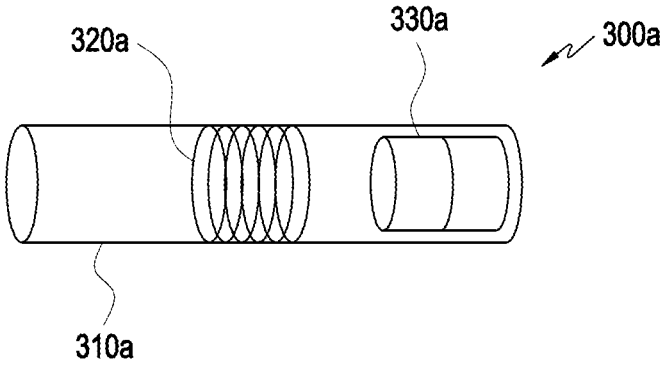
FIGS. 3D and 3E are diagrams illustrating a magnetic field induction-type harvester according to various embodiments.

FIG. 3D is a diagram illustrating an example structure of a magnetic field induction-type harvester according to various embodiments. A magnetic field induction-type harvester 300*a* according to various embodiments may include a guide 310*a*, a coil 320*a* wound around the guide, and a magnet 330*a* movably disposed in the guide. The magnet 330*a* may move in the guide according to the movement of the magnetic field induction-type harvester 300*a*, and when the magnet 330*a* passes a part of the guide 310*a* where the coil 320*a* is disposed, an induced electromotive force is generated in the coil 320*a* due to a change in magnetic flux at the cross section of the coil 320*a*.

In the example illustrated in FIG. 3D, the guide 310*a* may have a cylindrical shape. In addition, sizes related to the guide 310*a*, the coil 320*a*, and the magnet 330*a*, illustrated in FIG. 3A, are all merely examples. According to various embodiments, the magnetic field induction-type harvester 300*a* may include multiple coils 320*a*. According to various embodiments, the magnet 330*a* may have an ellipsoidal shape. According to various embodiments, the magnet 330*a* may have a size and a shape that do not allow the magnet 330*a* to be flipped in the guide 310*a*.

Figure 3E:
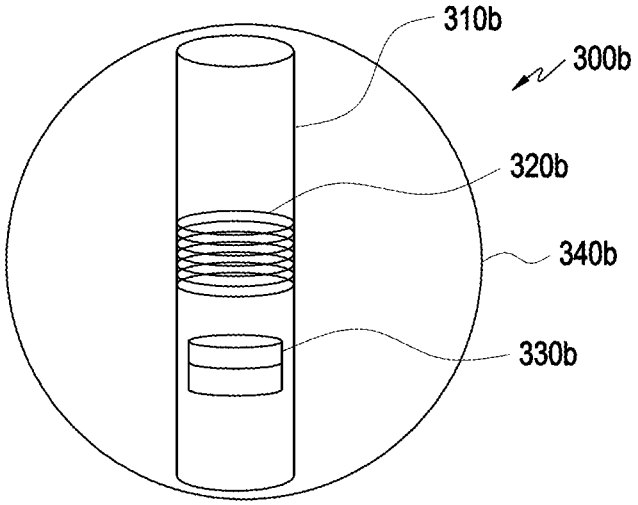

FIG. 3E is a diagram illustrating an example structure of a housing in which a magnetic field induction-type harvester according to various embodiments is disposed. In a sensor device 300*b* illustrated in FIG. 3E, a magnetic field induction-type harvester including a guide 310*b*, a coil 320*b*, and a magnet 330*b* may be disposed in a housing 340*b* of the sensor device 300*b*. According to various embodiments, the housing 340*b* of the sensor device 300*b* may have a spherical shape. According to various embodiments, the housing 340*b* of the sensor device 300*b* may have various three-dimensional shapes such as a hexahedron, a tetrahedron, an elliptical sphere, and a rugby ball shape. The details of the magnetic field induction-type harvester illustrated in FIG. 3E are the same as or similar to those described with reference to FIG. 3D, and thus will not be repeated here.

Figure 4:
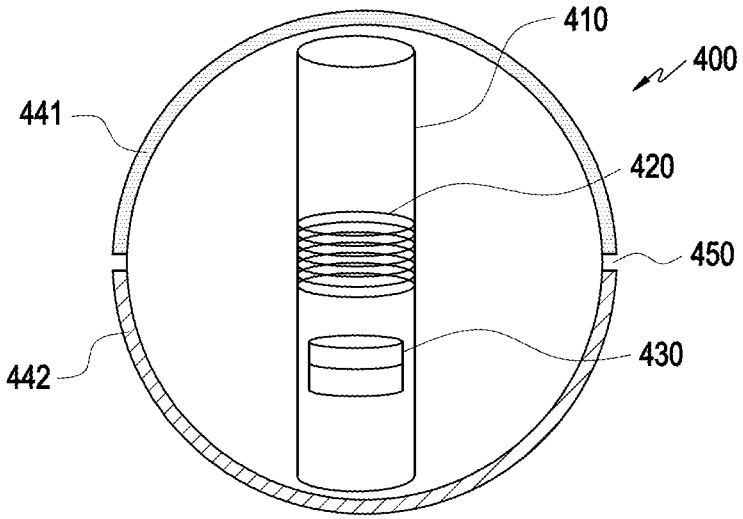
FIG. 4 is a diagram illustrating an example structure of an energy harvester including a magnetic field induction-type harvester and a triboelectric harvester according to various embodiments.

FIG. 4 is a diagram illustrating an example structure of an energy harvester including a magnetic field induction-type harvester and a triboelectric harvester according to various embodiments. According to various embodiments, a sensor ball 400 may include triboelectric electrodes 441 and 442 disposed on an outer surface of a housing 450. The triboelectric electrodes 441 and 442 may be included in a triboelectric harvester that harvests electrical energy generated by friction between the sensor ball 400 and an adjacent object. According to various embodiments, the sensor ball 400 may include, in a housing 450, a guide 410, a coil 420 wound around the guide 410, and a magnet 430 movably disposed in the guide. As described above, the guide 410, the coil 420, and the magnet 430 may be included in a magnetic field induction-type harvester.

Figure 5:
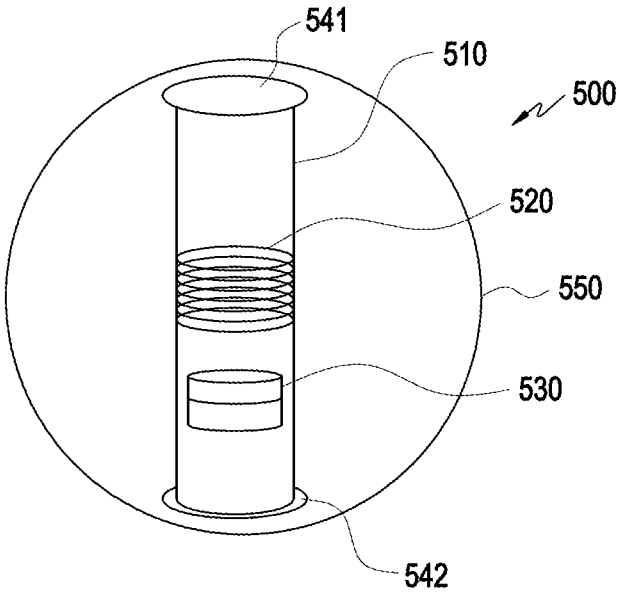
FIG. 5 is a diagram illustrating an example structure of an energy harvester including a magnetic field induction-type harvester and a piezoelectric harvester according to various embodiments.

FIG. 5 is a diagram illustrating an example structure of an energy harvester including a magnetic field induction-type harvester and a piezoelectric harvester according to various embodiments. According to various embodiments, a sensor ball 500 may include, within a housing 550, a guide 510, a coil 520 wound around the guide 510, and a magnet 530 movably disposed in the guide 510. As described above, the guide 510, the coil 520, and the magnet 530 may be included in a magnetic field induction-type harvester. According to various embodiments, piezoelectric elements 541 and 542 may be disposed at both ends of the guide 510 included in the sensor ball 500. The piezoelectric elements 541 and 542 may be included in a piezoelectric harvester. According to various embodiments, when the magnet 530 moves according to the movement of the housing 550 of the sensor ball 500 to push the piezoelectric elements 541 and 542, the piezoelectric elements 541 and 542 may generate electrical energy using this mechanical force.

Figure 6:
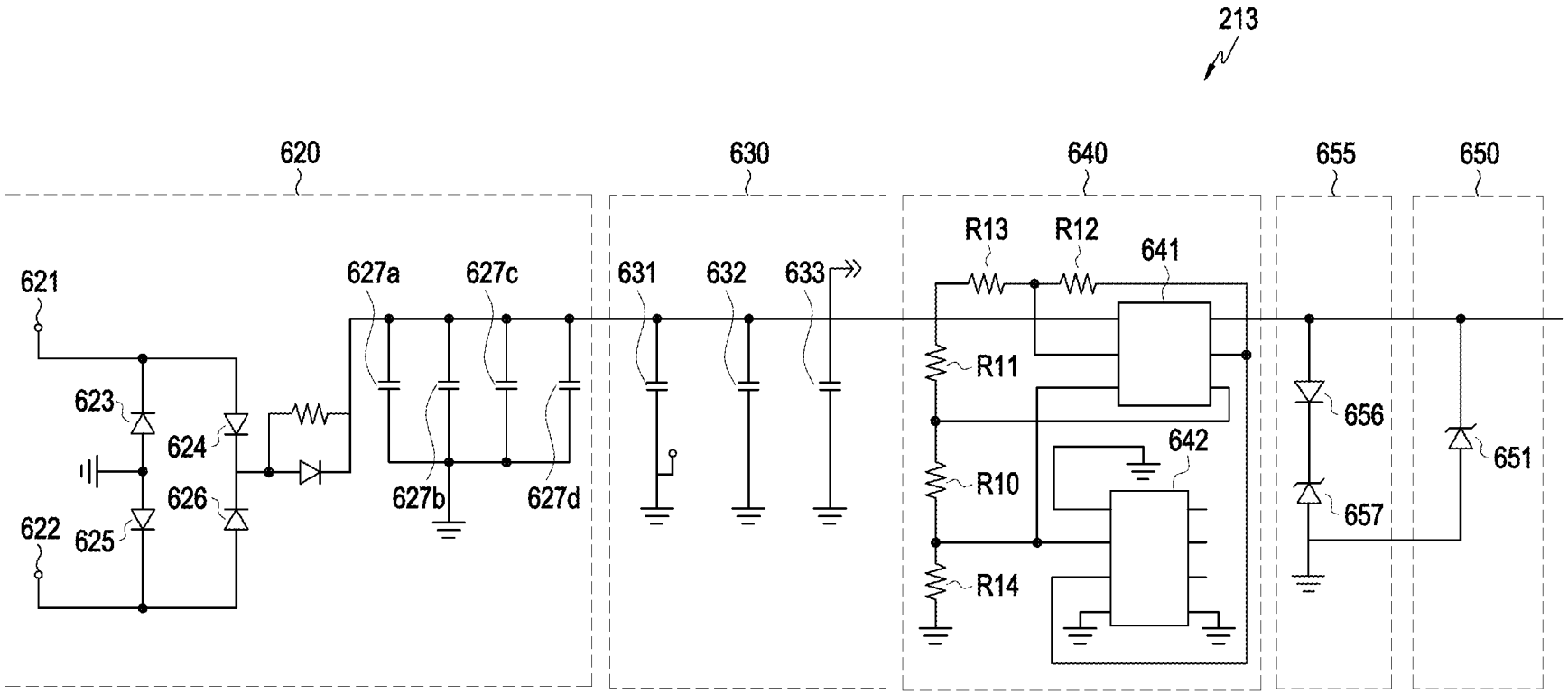
FIG. 6 is a circuit diagram of an energy harvesting module according to various embodiments.

FIG. 6 is a circuit diagram illustrating an example energy harvesting module according to various embodiments. According to various embodiments, FIG. 6 may be included as at least a part of the energy harvesting module 213 illustrated in FIG. 2A. For example, the circuit illustrated in FIG. 6 may correspond to at least some of the rectifier circuit 220, the energy storage circuit 230, the switch 240, and the protection circuit 250 illustrated in FIG. 2B. Referring to FIG. 6, a rectifier circuit 620 may correspond to the rectifier circuit 220 illustrated in FIG. 2B, an energy storage circuit 630 may correspond to the energy storage circuit 230 illustrated in FIG. 2B, a switch 640 may correspond to the switch 240 illustrated in FIG. 2B, and a protection circuit 650 may correspond to the protection circuit 250 illustrated in FIG. 2B. In the example in FIG. 6, it is illustrated that a bleeder circuit 655 is further include between the switch 640 and the protection circuit 650. However, according to various embodiments, the sensor device may not include the bleeder circuit 655.

According to various embodiments, the rectifier circuit 620 may include terminals 621 and 622 to be connected to an energy harvester (e.g., the energy harvester 210). The rectifier circuit 620 may include a bridge rectifier including multiple diodes 623, 624, 625, and 626. According to various embodiments, the rectifier circuit 620 may further include multiple capacitors 627*a*, 627*b*, 627*c*, and 627*d*. The rectifier circuit 620 may convert AC power generated by the energy harvester 210 into DC power.

According to various embodiments, the energy storage circuit 630 may include multiple capacitors 631, 632, and 633. According to various embodiments, the multiple capacitors 631, 632, and 633 may store energy based on the power converted by the rectifier circuit 620. According to various embodiments, since the multiple capacitors 631, 632, and 633 are connected in parallel, the voltage of one of the multiple capacitors 631, 632, and 633 may be determined to be the voltage of the energy storage circuit 630.

According to various embodiments, the switch 640 may be a hysteresis switch as illustrated in FIG. The switch 640 may include multiple resistors R10, R11, R12, R13, and R14, two p-channel FETs 641, and one n-channel FET 642. According to various embodiments, a source of a first p-channel FET of the two p-channel FETs 641 may be an input terminal of the switch 640 and may be connected between R11 and R13, a drain of the first p-channel FET may be an output terminal of the switch 640, and a gate of the first p-channel FET may be connected between R13 and R12. A source of a second p-channel FET of the two p-channel FETs 641 may be connected between R10 and R11, a drain of the second p-channel FET may be connected to a gate of the n-channel FET 642 while being connected between R10 and R14, and a gate of the second p-channel FET is connected to the drain of the n-channel FET 642. A source of the n-channel FET 642 may be connected to a ground.

Figure 7A:
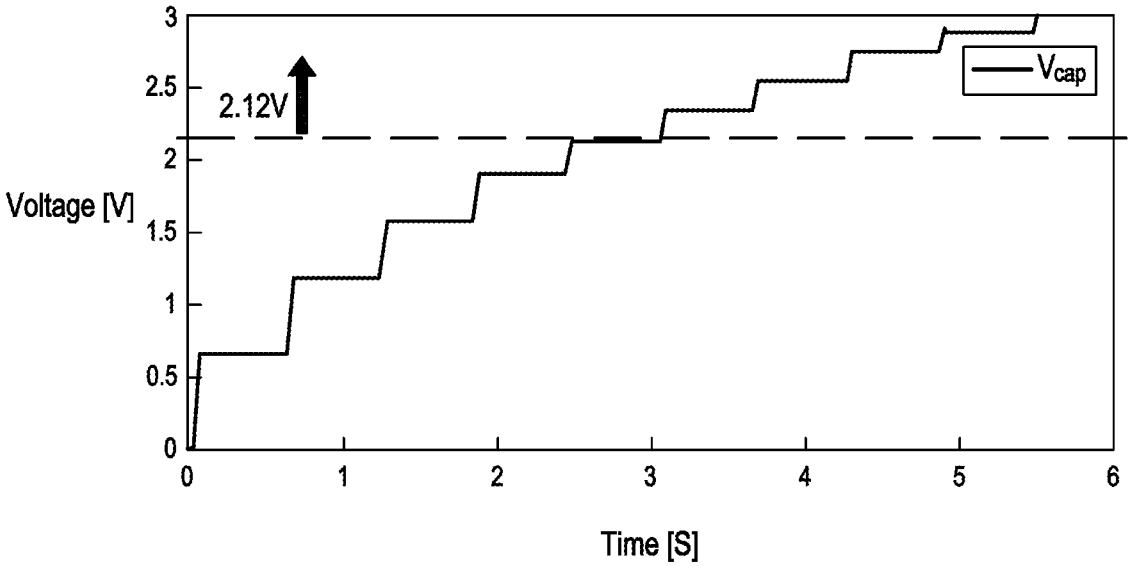
FIG. 7A is a graph showing the voltage of an energy harvesting module according to various embodiments.

FIG. 7A is a graph showing the voltage of an energy harvesting module according to various embodiments. Referring to FIG. 7A, when the sensor ball 130 moves, energy stored in the energy storage circuit 230 of the energy harvesting module 213 may be increased, and thus a voltage measured in the energy storage circuit 230 may be increased. According to various embodiments, when the sensor ball 130 continues to move, the voltage of the capacitor of the energy storage circuit 230 continues to increase, as illustrated in FIG. 7A, and when the voltage exceeds a specific value (e.g., 2.12V), the switch 240 may be switched to an ON state.

Figure 7B:
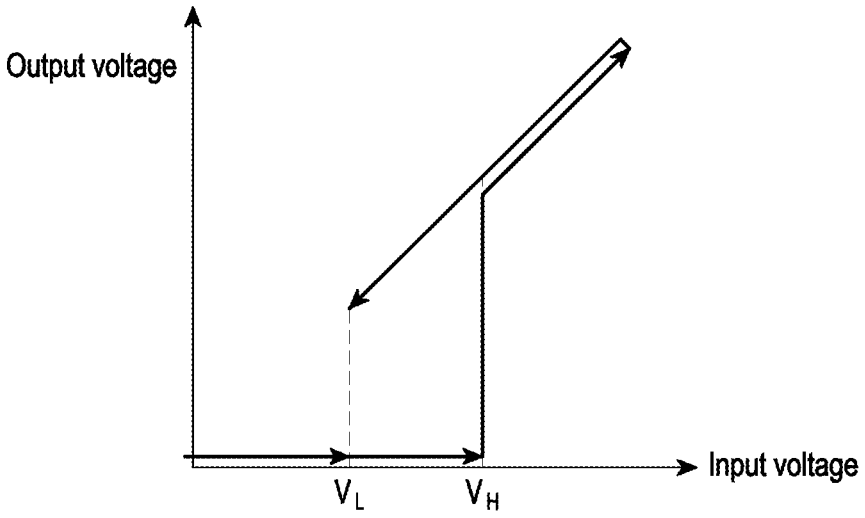
FIGS. 7B and 7C are graphs illustrating the operation of a hysteresis switch according to various embodiments.
Figure 7C:
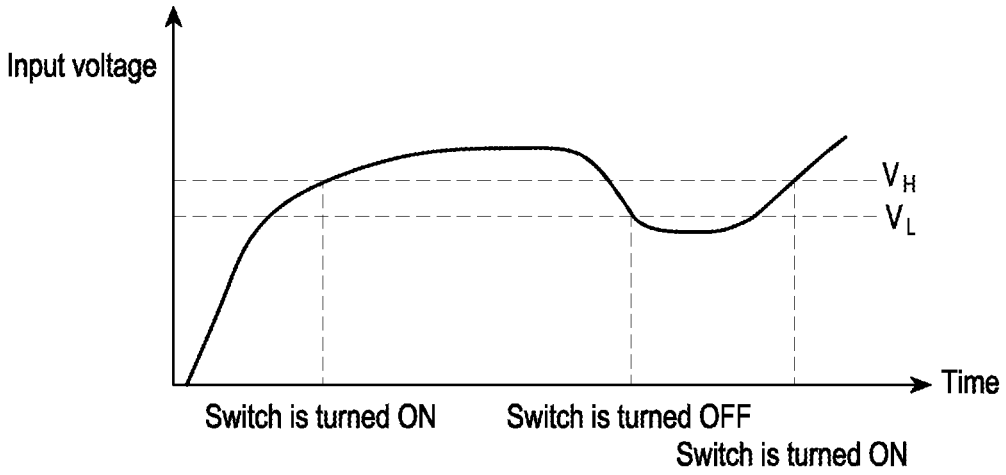

FIGS. 7B and 7C are graphs illustrating the operation of a hysteresis switch according to various embodiments. Referring to FIG. 7B, when an input voltage is lower than VL, an output voltage may be 0 or close to 0. When the input voltage that used to be below VL increases to have a value higher than VL and lower than VH, the output voltage may still be 0 or close to 0. When the input voltage is higher than VH, the output voltage may be equal to the input voltage or close to a configured value. When the input voltage that used to be higher than VH decreases to have a value higher than VL and lower than VH, the output voltage may be equal to the input voltage or close to the configured value.

FIG. 7C shows an operation state of a hysteresis switch when an input voltage starts from 0 and increases or decreases with time according to various embodiments. In an interval in which an input voltage starts from 0 and increases, the hysteresis switch (e.g., the switch 240) may be turned on at a point where the input voltage is VH. After that, the input voltage may decrease again after maintaining a value higher than VH. For example, within an interval in which the input voltage is higher than VH and then decreases, the hysteresis switch may be turned off at a point where the input voltage is VL. After that, the input voltage may increase after maintaining a value lower than VL, and in the interval where the input voltage is lower than VL and then increases, the hysteresis switch may be turned on at a point where the input voltage is VH.

According to various embodiments, VL may be set to the lowest voltage capable of driving the controller 212 (or the processor). It may be seen that the above-described hysteresis switch delays a time point of turning-off of the switch in a situation where the input voltage is decreasing while the hysteresis switch is turned on, and delays a time point of turning-on of the switch in a situation where the input voltage is increasing while the hysteresis switch is turned off. Therefore, the hysteretic switch may delay a time point at which power is not supplied to the processor in a situation where output power of the energy harvester decreases, and may delay a time point of supplying power to the processor until the power is further accumulated in the energy storage device in a situation where the output power of the energy harvester increases, so that the power can be supplied to the processor for a longer time. In addition, the magnitude of the harvested energy may be changed to prevent and/or reduce the controller and/or the communication circuit from being frequently turned on/off, and thus a stable communication connection between the sensor ball 130 and the electronic device 110 may be guaranteed.

Referring back to FIG. 6, according to various embodiments, the bleeder circuit 655 may increase power consumption when the voltage of the energy storage circuit 630 exceeds a threshold value. The bleeder circuit 655 may include an LED 656 and a Zener diode 657. When the voltage of the energy storage circuit 630 is equal to or lower than a Zener voltage of the Zener diode 657, a current may not flow in the LED 656. When the voltage of the energy storage circuit 630 exceeds the Zener voltage of the Zener diode 657, a current may flow in the LED 656, and accordingly, the LED 656 may emit light, thereby increasing power consumption. According to various embodiments, the Zener diode 657 having a threshold value for increasing power consumption as a Zener voltage is employed, and thus power consumption may be increased when the voltage of the energy storage circuit 630 exceeds the threshold value.

According to various embodiments, the protection circuit 650 may include a Zener diode 651 and may have a structure in which the Zener diode 651 is connected to a ground terminal. According to various embodiments, the Zener voltage of the Zener diode 651 may be greater than the Zener voltage of the Zener diode 657. When the voltage of an output terminal of the switch 640 is greater than the Zener voltage of the Zener diode 651, the protection circuit 650 may protect the sensor device by sending a current to the ground terminal.

Figure 8:
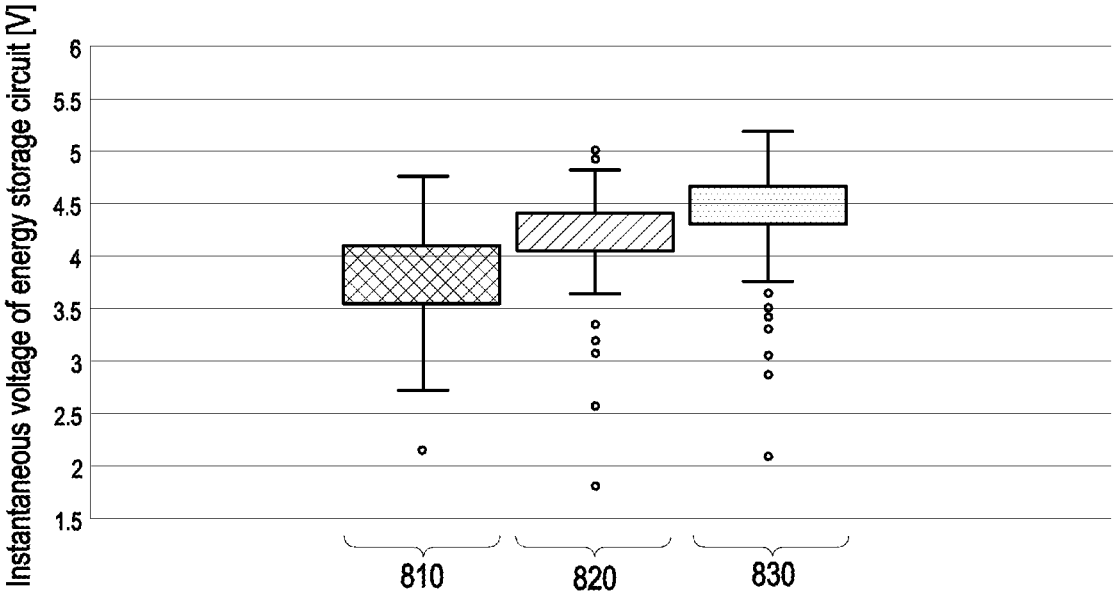
FIG. 8 is a graph illustrating the distribution of instantaneous voltage of an energy storage circuit with respect to the weight or volume of an electronic device according to various embodiments.

FIG. 8 is a graph illustrating the distribution of instantaneous voltage of an energy storage circuit according to various weights or volumes of laundry according to various embodiments. According to various embodiments, while drying is progressing in a dryer (e.g., the electronic device 110) including laundry (e.g., the laundry 120) and a sensor device (e.g., the sensor ball 130), the sensor ball may periodically check an instantaneous voltage of the energy storage circuit, and may transmit the instantaneous voltage to the dryer. According to various embodiments, a period in which a controller of the sensor ball checks the instantaneous voltage of the energy storage circuit through the monitoring circuit may be shorter than a period in which at least one processor of the sensor ball transmits a signal indicating the instantaneous voltage of the energy storage circuit to the dryer through a communication circuit. FIG. 8 illustrates the distribution of data on instantaneous voltage of the energy storage circuit identified by the sensor ball and transmitted to the dryer from the start of drying to the completion of drying. For example, a first distribution 810 shows the distribution of instantaneous voltage of the energy storage circuit when the amount of the laundry 120 is the maximum amount allowed by the dryer. A second distribution 820 shows the distribution of instantaneous voltage of the energy storage circuit when the amount of laundry 120 is a first amount less than the maximum amount allowed by the dryer. A third distribution 830 shows the distribution of instantaneous voltage of the energy storage circuit when the amount of the laundry 120 is a second amount less than the first amount.

Referring to FIG. 8, it may be determined that the instantaneous voltage of the energy storage circuit is generally distributed at a lower voltage value as the amount of the laundry 120 increases. Accordingly, the sensor ball 130 or the electronic device 110 may determine the amount of the laundry 120, that is, the weight or volume of the laundry 120, based on the instantaneous voltage of the energy storage circuit.

Figure 9:
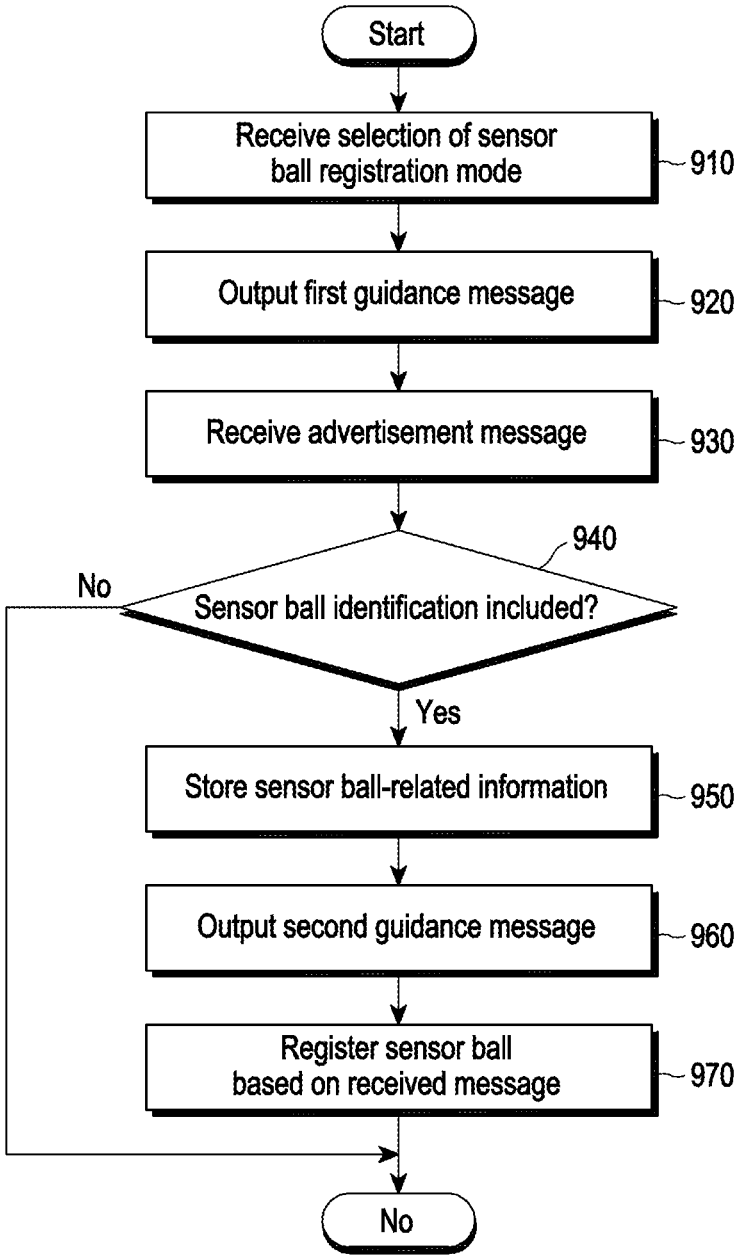
FIG. 9 is a flowchart illustrating example operations of an electronic device according to various embodiments.

FIG. 9 is a flowchart illustrating example operations of an electronic device according to various embodiments. Referring to FIG. 9, an electronic device (e.g., the electronic device 110 in FIG. 1) (e.g., a washing machine or a dryer) may receive a selection of a sensor ball registration mode in operation 910. For example, the sensor ball registration mode may be selected by a user through an input module 207 (e.g., a button) provided in the electronic device 110.

According to an embodiment, when the electronic device 110 operates for the first time or when there is no currently registered sensor ball, the sensor ball registration mode may be automatically executed to induce registration of a sensor ball.

According to various embodiments, in operation 920, the electronic device 110 may output a first guidance message according to the selection of the sensor ball registration mode. The first guidance message may include a guidance message related to shaking the sensor ball. According to various embodiments, as illustrated in FIG. 10A, the electronic device 110 may control a display 203 to display the first guidance message as a screen 1010 or a speaker 205 to output as voice. For example, the first guidance message may include a message inducing the user to shake a sensor ball, such as "Shake the sensor ball for 10 seconds to register the sensor ball for the first time" or "Shake the sensor ball for 10 seconds while pressing a sensor ball registration button to register the sensor ball for the first time". According to various embodiments, the electronic device 110 may drive a timer for a predetermined first time along with the output of the first guidance message.

According to various embodiments, when the user shakes the sensor ball 130 after checking the first information message, as described above, electric energy may be generated by the energy harvesting module 213 of the sensor ball 130, and the generated electrical energy may be stored in an energy storage circuit. When the user continues to shake a sensor ball 130, the voltage of the energy storage circuit of the sensor ball 130 may be continuously increased. A controller 212 of the sensor ball 130 may identify information about the voltage of the energy storage circuit, and may transmit the information about the voltage through a communication circuit 211. According to various embodiments, when the communication circuit 211 is a BLE module, the information about the voltage may be included in a BLE advertisement message and transmitted. The BLE advertisement message may include information (e.g., a BLE service ID) indicating that the device having transmitted the message is a sensor ball and identification information (e.g., UUID) of the sensor ball. For example, the BLE advertisement message may be configured as shown in <Table 1> and <Table 2> below.

According to various embodiments, in operation 930, the electronic device 110 may receive an advertisement message. The advertisement message may include a BLE advertisement message. The electronic device 110 having received the BLE advertisement message may identify the service ID included in the BLE advertisement message, and may determine that the type of electronic device having transmitted the BLE advertisement message is the sensor ball 130. For example, in operation 940, the electronic device 110 may ignore the received advertisement message when sensor ball identification information (e.g., a service ID corresponding to the sensor ball) is not included in the advertisement message.

According to various embodiments, when it is determined in operation 940 that the advertisement message includes the sensor ball identification information (e.g., a service ID corresponding to the sensor ball), the electronic device 110 may store sensor ball-related information in a memory 206 in operation 950. The information stored in the memory 206 may include a device ID of the sensor ball and voltage information of an energy harvesting module of the sensor ball. For example, the electronic device 110 having received the BLE advertisement message may identify the device ID of the sensor ball included in the BLE advertisement message, and may distinguish or identify the sensor ball having transmitted the BLE advertisement message.

According to various embodiments, the electronic device 110 may receive, based on the driven timer, the BLE advertisement message of operation 930 once or twice or more within the predetermined first time. According to various embodiments, the electronic device 110 may map voltage information included in the BLE advertisement message to the identification information of the sensor ball 130 and store the voltage information in the memory 206.

According to various embodiments, when it is determined that the predetermined first time has expired according to the driving of the timer, the electronic device 110 may generate and output a second guidance message in operation 960. The second guidance message may include a guidance message related to stopping shaking the sensor ball 130. According to various embodiments, as illustrated in FIG. 10B, the electronic device 110 may control to display (1020) the generated second guidance message to be displayed (1020) as a screen through the display 203 or to be outputs as a voice through the speaker 205. For example, the second guidance message may include a message inducing the user to stop shaking the sensor ball 130, such as "Please stop shaking the sensor ball now.".

When the user stops shaking the sensor ball 130 according to the second guidance message, the voltage of the energy storage circuit included in the sensor ball 130 may be reduced. When the voltage of the energy storage circuit is reduced, the sensor ball 130 may no longer transmit a BLE advertisement message, or may transmit a BLE advertisement message including information about the reduced voltage.

According to various embodiments, in operation 970, the electronic device 110 may register the sensor ball based on the message received from the sensor ball. For example, the electronic device 110 may determine whether a BLE advertisement message is received for a predetermined second time after outputting the second information message. The electronic device 101 may register, based on whether the BLE advertisement message is received after outputting the second guidance message, the sensor ball 130 corresponding to the BLE advertisement message received for the predetermined first time. For example, when it is determined that no BLE advertisement message is additionally received for the predetermined second time, the electronic device 110 may register the sensor ball 130 that has transmitted the BLE advertisement message received for the first time. The electronic device 110 may process the corresponding BLE advertisement message only when subsequently received BLE advertisement message includes identification information (e.g., UUID) of a sensor ball corresponding to the registered sensor ball 130. For example, the electronic device 110 may control the operation of the electronic device 110 (e.g., driving of the actuator 204) based on various types of information included in a BLE advertisement message subsequently transmitted from the registered sensor ball 130.

According to an embodiment, the electronic device 110 may identify voltage information included in a BLE advertisement message received during the predetermined second time, and may register the sensor ball 130 that transmitted the BLE advertisement message when the identified voltage is lower than a voltage identified through a previously received BLE advertisement message.

Figure 11:
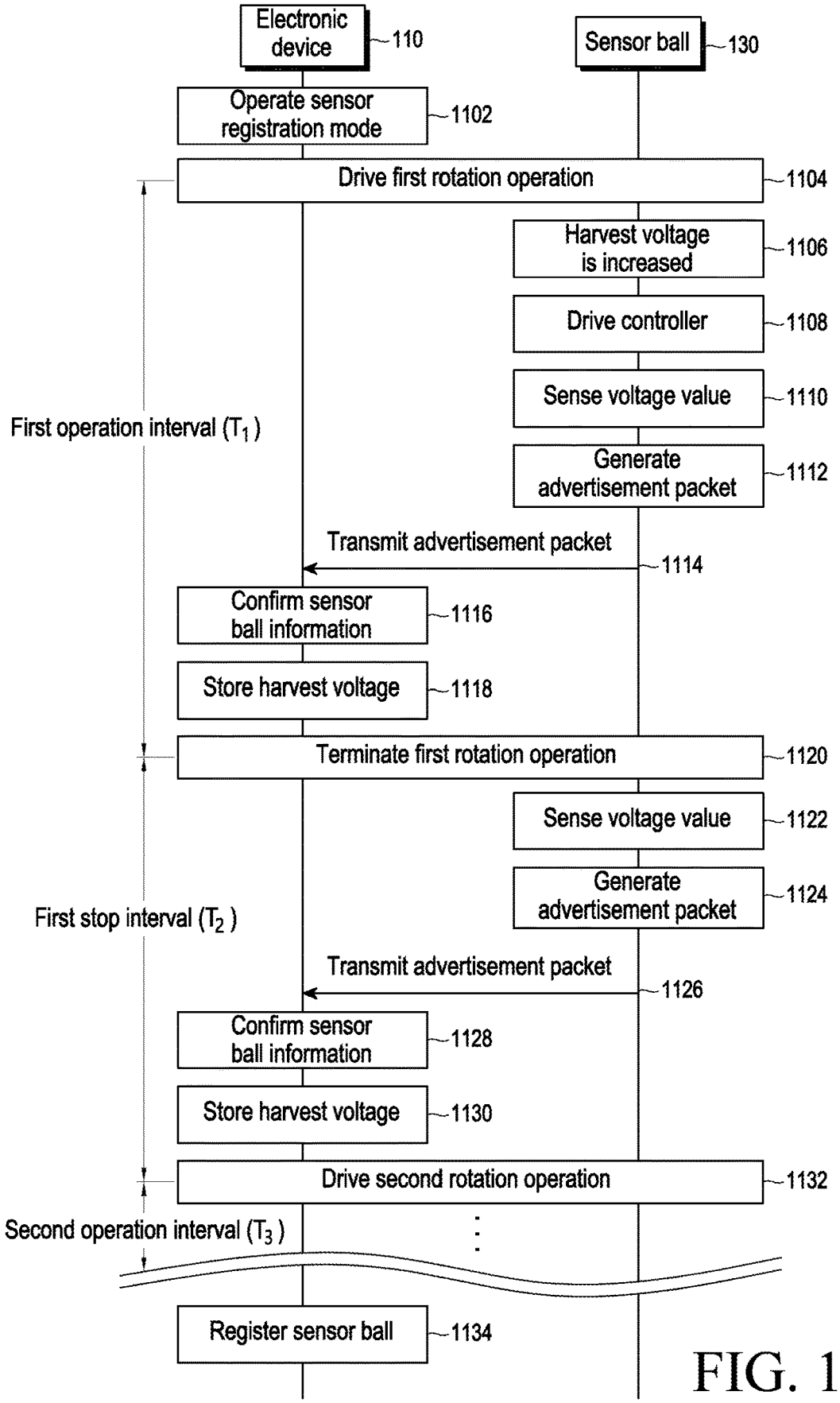
FIG. 11 is a signal flow diagram illustrating example operations of an electronic device and a sensor ball according to various embodiments.

FIG. 11 is a signal flow diagram illustrating example operations of an electronic device and a sensor ball according to various embodiments. Referring to FIG. 11, according to various embodiments, in operation 1102, the electronic device 110 may operate in a sensor ball registration mode. For example, when the electronic device 110 is a washing machine or a dryer, a user may put laundry or objects to be dried and a sensor ball into a drum, and then execute a washing mode or a drying mode. According to various embodiments, when the sensor ball is not registered or when the sensor ball needs to be registered, the electronic device 110 may automatically perform a sensor ball registration mode before starting the washing mode or the drying mode.

According to the sensor ball registration mode operation, the electronic device 110 may drive an actuator in operation 1104 to drive a first rotation operation during a first operation interval T1. When the electronic device 110 drives the first rotation operation, the sensor ball 130 may perform free movement in the electronic device 110 as illustrated in FIG. 1.

According to various embodiments, in operation 1106, the harvest voltage of the sensor ball 130 may be increased by the free movement. When the harvest voltage increases to a predetermined voltage or higher, a controller of the sensor ball 130 may be driven in operation 1108. The sensor ball 130 may sense a voltage value in operation 1110. The sensor ball 130 may generate an advertisement packet including the sensed voltage value in operation 1112, and may transmit the generated advertisement packet in operation 1114.

According to various embodiments, in operation 1116, the electronic device 110 may receive the advertisement packet transmitted from the sensor ball 130 and identify sensor ball information (e.g., a service ID). As a result of the identifying, when the electronic device having transmitted the advertisement packet is a sensor ball, the electronic device 110 may map a voltage (e.g., a harvest voltage) included in the advertisement packet to identification information (e.g., UUID) of the sensor ball and store the voltage in a memory (e.g., the memory 206) in operation 1118.

According to various embodiments, in operation 1120, the electronic device 110 may terminate the first rotation operation during a first stop interval T2. According to various embodiments, the sensor ball 130 may stop the free movement and may no longer generate power. The sensor ball 130 may continue to operate using previously generated and stored harvest power. According to various embodiments, the sensor ball 130 may sense a voltage value in operation 1122. When the free movement of the sensor ball 130 is stopped, the sensed voltage value may be a reduced voltage compared to a previously sensed voltage value. The sensor ball 130 may generate an advertisement packet including the sensed voltage value in operation 1124, and may transmit the generated advertisement packet in operation 1126.

According to various embodiments, in operation 1128, the electronic device 110 may receive the advertisement packet transmitted from the sensor ball 130 and may identify sensor ball information (e.g., a service ID). As a result of the identifying, when an electronic device having transmitted the advertisement packet is a sensor ball, ball in operation 1130, the electronic device 110 may map the voltage (e.g., a harvest voltage) included in the advertisement packet to identification information (e.g., UUID) of the sensor and store the voltage in the memory (e.g., the memory 206).

According to various embodiments, the electronic device 110 may drive an actuator in operation 1132 to drive a second rotation operation during a second operation interval T3. According to various embodiments, the operation interval and stop interval of the actuator for the sensor ball registration mode may be repeatedly performed.

According to various embodiments, in operation 1134, the electronic device 110 may register the sensor ball, based on the received advertisement packet. For example, the electronic device 110 may determine whether the stored voltage information has been increased in the operation interval and has been decreased in the stop interval, and may register a device ID (e.g., UUID) of a sensor ball corresponding thereto. Thereafter, the electronic device 110 may control the operation of the electronic device 110 using only a sensing value, received from the registered sensor ball, during, for example, the washing mode or drying mode operation.

Figure 12:
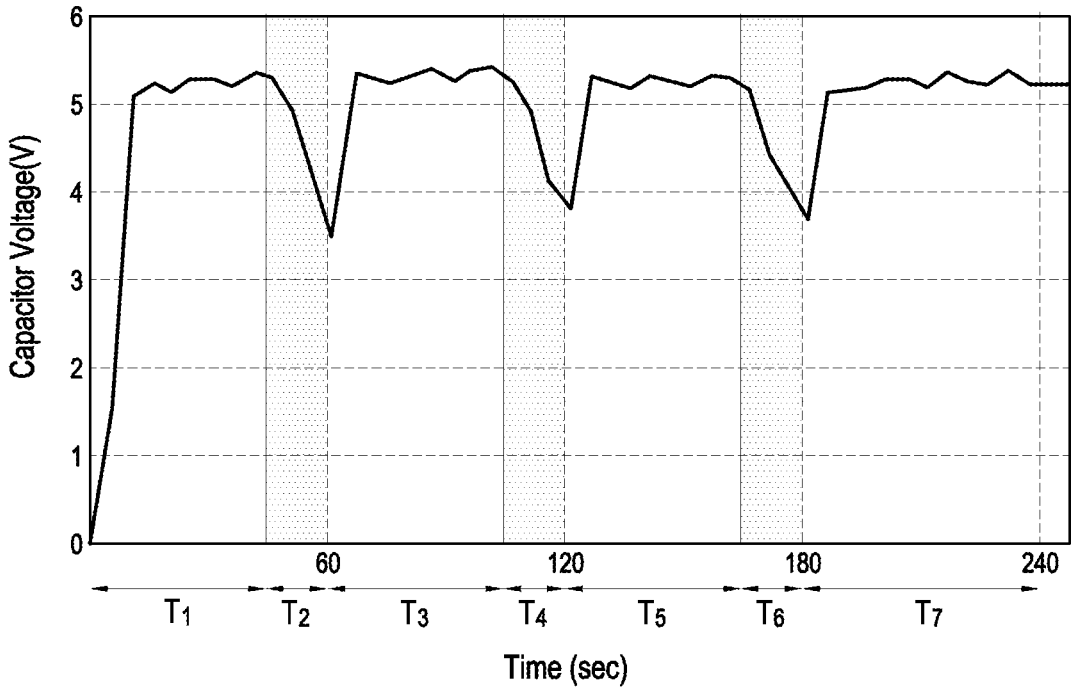
FIG. 12 is a graph showing the voltage of an energy harvesting module according to various embodiments.

FIG. 12 is a graph showing the voltage of an energy harvesting module according to various embodiments. Referring to FIG. 12, the voltage of a harvesting module included in the sensor ball 130 may be increased or maintained during rotation operation intervals $T_1$, $T_3$, $T_5$, and $T_7$ in which the actuator 204 of the electronic device 110 is driven. On the other hand, it may be seen that the voltage of the harvesting module is reduced intervals $T_2$, $T_4$, $T_6$, and $T_5$ in which the actuator 204 of the electronic device 110 is stopped. According to various embodiments, the electronic device 110 may register the sensor ball based on the voltage of the harvesting module of the sensor ball 130.

Figure 13:
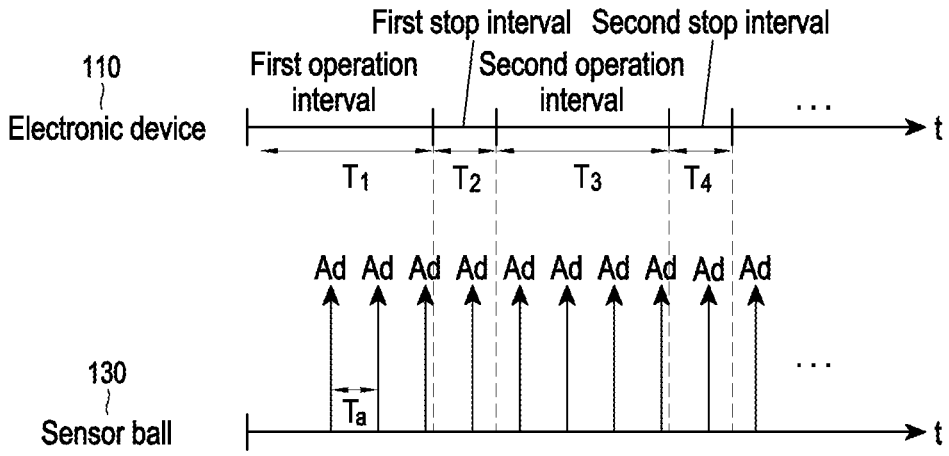
FIG. 13 is a diagram illustrating example advertisement message transmission by a sensor ball according to various embodiments.

FIG. 13 is a diagram illustrating transmission of advertisement message from a sensor ball according to various embodiments. Referring to FIG. 13, an advertisement message from the sensor ball 130 may be transmitted at regular intervals Ta. According to various embodiments, a time taken to register the sensor ball 130 may be reduced by adjusting the length of an operation interval of the electronic device 110 and the transmission period of an advertisement message from the sensor ball.

Figure 14:
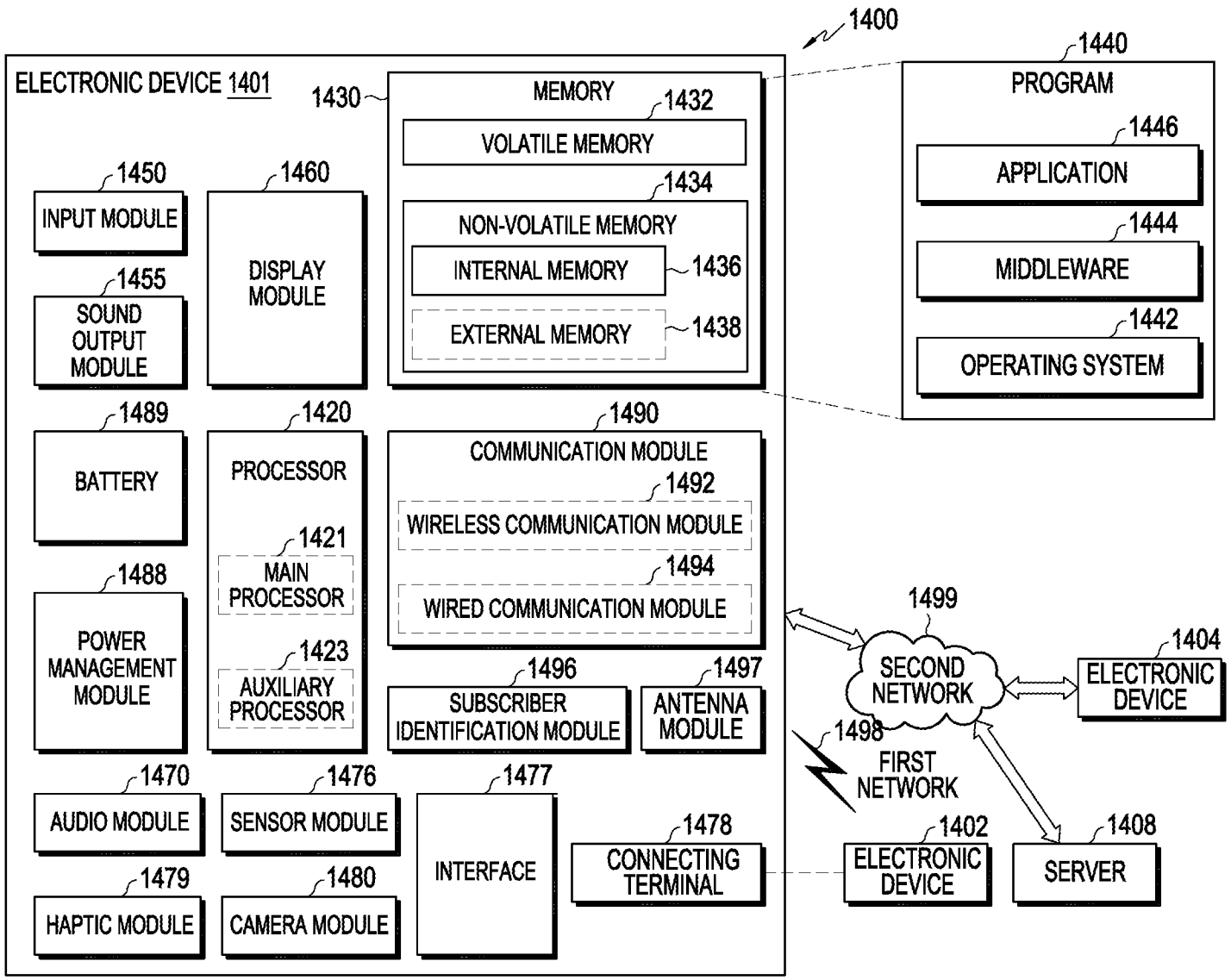
FIG. 14 is a block diagram illustrating an example electronic device in a network environment according to various embodiments.

FIG. 14 is a block diagram illustrating an example electronic device 1401 (e.g., the electronic device 110 or the sensor ball 130 of FIG. 1) in a network environment 1400 according to various embodiments. Referring to FIG. 14, the electronic device 1401 in the network environment 1400 may communicate with an electronic device 1402 via a first network 1498 (e.g., short-range wireless communication), or an electronic device 1404 or a server 1408 via a second network 1499 (e.g., long-range wireless communication). According to an embodiment, the electronic device 1401 may communicate with the electronic device 1404 via the server 1408. According to an embodiment, the electronic device 1401 may include a processor 1420 (e.g., the controller 202 or 212 of FIG. 2A), memory 1430 (e.g., the memory 206 of FIG. 2A), an input device 1450 (e.g., the input module 207 of FIG. 2A), a sound output device 1455 (e.g., the speaker 205 of FIG. 2A), a display device 1460 (e.g., the display 203 of FIG. 2A), an audio module 1470 (e.g., the speaker 205 of FIG. 2A), a sensor module 1476 (e.g., the sensor 214 of FIG. 2A), an interface 1477, a haptic module 1479, a camera module 1480, a power management module 1488, a battery 1489, a communication module 1490 (e.g., the communication circuit 201 or 211 of FIG. 2A), a subscriber identification module (SIM) 1496, or an antenna module 1497. In various embodiments, at least one (e.g., the display device 1460 or the camera module 1480) of the components may be omitted from the electronic device 1401, or other components may be added in the electronic device 1401. In various embodiments, for example, some components may be implemented to be integrated as in a case of the sensor module 1476 (e.g., a fingerprint sensor, an iris sensor, or an illuminance sensor) embedded in the display device 1460.

The processor 1420 may operate, for example, software (e.g., a program 1440) to control at least one other component (e.g., a hardware or software component) of the electronic device 1401 coupled with the processor 1420, and may perform various data processing and computation. The processor 1420 may load a command or data received from another component (e.g., the sensor module 1476 or the communication module 1490) in volatile memory 1432, process the same, and store resulting data in non-volatile memory 1434. According to an embodiment, the processor 1420 may include a main processor 1421 (e.g., a central processing unit (CPU) or an application processor (AP)), and an auxiliary processor 1423 (e.g., a graphics processing unit (GPU), an image signal processor (ISP), a sensor hub processor, or a communication processor (CP)) that is operated independently from the main processor 1421, and additionally or alternatively, consumes less power than the main processor 1421, or to be specific to a specified function. Here, the auxiliary processor 1423 may be operated as separate from, or as embedded in the main processor 1421.

In such a case, the auxiliary processor 1423 may control, for example, at least some of functions or states related to at least one component (e.g., the display device 1460, the sensor module 1476, or the communication module 1490) among the components of the electronic device 1401, instead of the main processor 1421 while the main processor 1421 is in an inactive (e.g., sleep) state, or together with the main processor 1421 while the main processor 1421 is in an active (e.g., performing an application) state. According to an embodiment, the auxiliary processor 1423 (e.g., an image signal processor or a communication processor) may be implemented as part of another component (e.g., the camera module 1480 or the communication module 1490) functionally related to the auxiliary processor 1423. The memory 1430 may store various data used by at least one component (e.g., the processor 1420 or the sensor module 1476) of the electronic device 1401, for example, software (e.g., the program 1440) and input data or output data for a command related thereto. The memory 1430 may include the volatile memory 1432 or the non-volatile memory 1434.

The program 1440 is software stored in the memory 1430, and may include, for example, an operating system (OS) 1442, middleware 1444, or an application 1446.

The input device 1450 is a device for receiving a command or data to be used by a component (e.g., the processor 1420) of the electronic device 1401, from the outside (e.g., a user) of the electronic device 1401, and may include, for example, a microphone, a mouse, or a keyboard.

The sound output device 1455 is a device for outputting sound signals to the outside of the electronic device 1401, and may include, for example, a speaker used for general purposes, such as playing multimedia or playing record, and a receiver used only for incoming calls. According to an embodiment, the receiver may be formed as integral to, or as separate from the speaker.

The display device 1460 is a device for visually providing information to a user of the electronic device 1401, and may include, for example, a display, a hologram device, or a projector and control circuitry to control a corresponding one of the display, hologram device, and projector. According to an embodiment, the display device 1460 may include touch circuitry, or a pressure sensor capable of measuring the intensity of the pressure by the touch.

The audio module 1470 may bidirectionally convert sound and electrical signals. According to an embodiment, the audio module 1470 may obtain the sound via the input device 1450, or output the sound via the sound output device 1455 or an external electronic device (e.g., an electronic device 1402 (e.g., a speaker or a headphone)) wiredly or wirelessly coupled with the electronic device 1401.

The sensor module 1476 may generate an electrical signal or data value corresponding to an internal operational state (e.g., power or temperature) of the electronic device 1401 or an environmental state external to the electronic device 1401. The sensor module 1476 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1477 may support a specified protocol which can be coupled with the external electronic device (e.g., the electronic device 1402) wiredly or wirelessly. According to an embodiment, the interface 1477 may include a high definition multimedia interface (HDMI), a universal serial bus (USB) interface, a secure digital (SD) card interface, or an audio interface.

A connecting terminal 1478 may include a connector capable of physically connecting the electronic device 1401 with the external electronic device (e.g., the electronic device 1402), for example, an HDMI connector, a USB connector, an SD card connector, or an audio connector (e.g., a headphone connector).

The haptic module 1479 may convert an electrical signal into a mechanical stimulus (e.g., a vibration or a movement) or electrical stimulus which may be recognized by a user via his tactile sensation or kinesthetic sensation. The haptic module 1479 may include, for example, a motor, a piezoelectric element, or an electric stimulator.

The camera module 1480 may capture a still image and moving images.

According to an embodiment, the camera module 1480 may include one or more lenses, image sensors, image signal processors, or flashes.

The power management module 1488 is a module for managing power supplied to the electronic device 1401, and may be configured as at least part of, for example, a power management integrated circuit (PMIC).

The battery 1489 is a device for supplying power to at least one component of the electronic device 1401, and may include, for example, a primary cell which is not rechargeable, a secondary cell which is rechargeable, or a fuel cell.

The communication module 1490 may support establishing a wired or wireless communication channel between the electronic device 1401 and the external electronic device (e.g., the electronic device 1402, the electronic device 1404, or the server 1408) and performing communication via the established communication channel. The communication module 1490 may include one or more communication processors supporting wired communication or wireless communication, which are operated independently from the processor 1420 (e.g., the application processor (AP)). According to an embodiment, the communication module 1490 may include a wireless communication module 1492 (e.g., a cellular communication module, a short-range wireless communication module, or a global navigation satellite system (GNSS) communication module) or a wired communication module 1494 (e.g., a local area network (LAN) communication module or a power line communication (PLC) module), and may communicate with the external electronic device via the first network 1498 (e.g., a short-range communication network, such as Bluetooth™, wireless-fidelity (Wi-Fi) direct, or infrared data association (IrDA)) or the second network 1499 (e.g., a long-range communication network, such as a cellular network, the Internet, or a computer network (e.g., LAN or wide area network (WAN)) using a corresponding one of the communication modules. The above-described various types of communication modules 1490 may be implemented as a single chip, or may be implemented as chips separate from each other.

According to an embodiment, the wireless communication module 1492 may distinguish and authenticate the electronic device 1401 in a communication network using user information stored in the subscriber identification module 1496.

The antenna module 1497 may include one or more antennas for transmitting or receiving signals or power to or from the outside. According to an embodiment, the communication module 1490 (e.g., the wireless communication module 1492) may transmit a signal to an external electronic device or receive a signal from the external electronic device through an antenna suitable for a communication method.

Some of the above-described components may be coupled mutually and communicate signals (e.g., commands or data) therebetween via an inter-peripheral communication scheme (e.g., a bus, general purpose input/output (GPIO), serial peripheral interface (SPI), or mobile industry processor interface (MIPI)).

According to an embodiment, commands or data may be transmitted or received between the electronic device 1401 and the external electronic device 1404 via the server 1408 coupled with the second network 1499. Each of the electronic devices 1402 and 1404 may be a device of a same type as, or a different type, from the electronic device 1401. According to an embodiment, all or some of operations to be executed at the electronic device 1401 may be executed at one or more of other external electronic devices. According to an embodiment, if the electronic device 1401 should perform a function or a service automatically, or upon a request, the electronic device 1401, instead of, or in addition to, executing the function or the service, may request at least some functions related thereto from an external electronic device. The external electronic device receiving the request may perform the requested function or an additional function, and transfer an outcome of the performing to the electronic device 1401. The electronic device 1401 may provide the requested function or service with or without further processing of the outcome. To that end, a cloud computing, distributed computing, or client-server computing technology may be used, for example.

An electronic device according to various example embodiments may include: a communication circuit, a display, an actuator, a speaker, and a controller electrically connected to the communication circuit, the display, the actuator, and the speaker, wherein the controller is configured to: control the display or the speaker to output a first guidance message in response to a selection input of a sensor ball registration mode, identify identification information of a sensor ball included in a sensor ball-related message received through the communication circuit for a specified time, control the display or the speaker to output a second guidance message based on the specified time expiring, and based on the specified time expiring, perform control to register a sensor ball corresponding to the sensor ball-related message received for the specified time, based on at least one sensor ball-related message received from the sensor ball.

According to various example embodiments, the sensor ball-related message may include information corresponding to a harvest voltage of the sensor ball or information corresponding to humidity sensed by the sensor ball.

According to various example embodiments, the controller may be configured to: identify the information corresponding to the harvest voltage and included in the sensor ball-related message, and control the sensor ball to be registered based on the identified information corresponding to the harvest voltage.

According to various example embodiments, the controller may be configured to: identify information corresponding to the harvest voltage of the sensor ball and included in at least one sensor ball-related message received through the communication circuit based on the specified time expiring, and based on the harvest voltage of the sensor ball being determined to be lower than a previously identified harvest voltage, may perform control to register a sensor ball corresponding to the sensor ball-related message.

According to various example embodiments, based on no sensor ball-related message being received from the sensor ball after the specified time has expired, the controller may be configured to perform control to register a sensor ball corresponding to the sensor ball-related message received for the specified time.

According to various example embodiments, the controller may be configured to: identify information corresponding to the harvest voltage of the sensor ball and included in each of multiple sensor ball-related messages received through the communication circuit for the specified time, and based on the harvest voltage of the sensor ball being determined to be higher than a harvest voltage identified from a previous sensor ball-related message, may perform control to register a sensor ball corresponding to the sensor ball-related message.

According to various example embodiments, the sensor ball-related message may be transmitted through an advertisement message of Bluetooth low energy (BLE).

An electronic device according to various example embodiments may include: a communication circuit, a display, an actuator, a speaker, and a controller electrically connected to the communication circuit, the display, the actuator, and the speaker, wherein the controller is configured to: control the actuator to be driven during a specified first operation interval, identify identification information of a sensor ball included in a sensor ball-related message received through the communication circuit during the specified first operation interval, control the actuator to be stopped during a specified first stop interval based on the specified first operation interval elapsing, and perform control to register, based on at least one sensor ball-related message received from the sensor ball, a sensor ball corresponding to the sensor ball-related message received for the specified time based on the specified first stop interval elapsing.

According to various example embodiments, the controller may be configured to: identify information corresponding to a harvest voltage of the sensor ball and included in the sensor ball-related message, and may control the sensor ball to be registered based on the identified information corresponding to the harvest voltage.

According to various example embodiments, the controller may be configured to: identify information corresponding to the harvest voltage of the sensor ball and included in at least one sensor ball-related message received through the communication circuit after the specified first stop interval has expired, and based on the harvest voltage of the sensor ball being determined to be lower than a previously identified harvest voltage, may perform control to register a sensor ball corresponding to the sensor ball-related message.

A sensor ball registration method of an electronic device, according to various example embodiments, may include: outputting a first guidance message through a display or a speaker in response to a selection input of a sensor ball registration mode, identifying identification information of a sensor ball included in a sensor ball-related message received through a communication circuit for a specified time, outputting a second guidance message through the display or the speaker based on the specified time expiring, and after the specified time has expired, registering a sensor ball corresponding to the sensor ball-related message received for the specified time, based on at least one sensor ball-related message received from the sensor ball.

According to various example embodiments, the sensor ball-related message may include information corresponding to a harvest voltage of the sensor ball or information corresponding to humidity sensed by the sensor ball.

According to various example embodiments, the method may include: identifying the information corresponding to the harvest voltage and included in the sensor ball-related message, and registering the sensor ball based on the identified information corresponding to the harvest voltage.

According to various example embodiments, the method may include: identifying information corresponding to the harvest voltage of the sensor ball and included in at least one sensor ball-related message received through the communication circuit after the specified time has expired, and based on the harvest voltage of the sensor ball being determined to be lower than a previously identified harvest voltage, registering a sensor ball corresponding to the sensor ball-related message.

According to various example embodiments, the method may include: registering, based on no sensor ball-related message being received from the sensor ball after the specified time has expired, a sensor ball corresponding to the sensor ball-related message received for the specified time.

According to various example embodiments, the method may include: identifying information corresponding to the harvest voltage of the sensor ball and included in each of multiple sensor ball-related messages received through the communication circuit for the specified time, and based on the harvest voltage of the sensor ball being determined to be higher than a harvest voltage identified from a previous sensor ball-related message, registering a sensor ball corresponding to the sensor ball-related message.

According to various example embodiments, the sensor ball-related message may be transmitted through an advertisement message of Bluetooth low energy (BLE).

A sensor ball registration method of an electronic device, according to various example embodiments, may include: controlling an actuator included in the electronic device to be driven during a specified first operation interval, identifying identification information of a sensor ball included in a sensor ball-related message received through a communication circuit during the specified first operation interval, controlling the actuator to be stopped during a specified first stop interval based on the specified first operation interval elapsing, and registering, based on at least one sensor ball-related message received from the sensor ball, a sensor ball corresponding to the sensor ball-related message received for the specified time based on the specified first stop interval elapsing.

According to various example embodiments, the method may include: identifying information corresponding to a harvest voltage of the sensor ball and included in the sensor ball-related message, and registering the sensor ball based on the identified information corresponding to the harvest voltage.

According to various example embodiments, the method may include: identifying information corresponding to the harvest voltage of the sensor ball and included in at least one sensor ball-related message received through the communication circuit after the specified first stop interval has expired, and based on the harvest voltage of the sensor ball being determined to be lower than a previously identified harvest voltage, registering a sensor ball corresponding to the sensor ball-related message.

It should be appreciated that various embodiments of the disclosure and the terms used therein are not intended to limit the technological features set forth herein to particular embodiments and include various changes, equivalents, and/or replacements for a corresponding embodiment. With regard to the description of the drawings, similar reference numerals may be used to refer to similar elements. It is to be understood that a singular expression may include multiple expressions, unless the relevant context clearly indicates otherwise. As used herein, expressions such as "A or B", "at least one of A and/or B", "A, B, or C", or "at least one of A, B, and/or C" may include all possible combinations of the items enumerated together. Expressions such as "1st", "2nd", "first" or "second" may modify corresponding components regardless of importance or order and are used to distinguish a component from another, without limiting the corresponding components. If an element (e.g., a first element) is referred to as being "(operatively or communicatively) coupled with/to," or "connected with/to" another element (e.g., a second element), the element may be coupled with the other element directly, or may be coupled via the other element (e.g., a third element).

As used herein, the term "module" may include a unit configured as hardware, software, or firmware, or any combination thereof, and may interchangeably be used with other terms, for example, "logic", "logic block", "part", or "circuitry". A module may be a single integral component, or a minimum unit or part thereof, adapted to perform one or more functions. For example, the module may be configured as an application-specific integrated circuit (ASIC).

Various embodiments as set forth herein may be implemented as software (e.g., a program) including instructions that are stored in a storage medium (e.g., machine-readable storage media (e.g., internal memory or external memory)) that is readable by a machine (e.g., a computer). A machine is a device capable of calling a stored instruction from a storage medium and operating according to the called instruction, and may include the electronic device according to the disclosed embodiments. When the command is executed by a processor (e.g., the controller 310), the processor may perform a function corresponding to the command directly or using other elements under the control of the processor. A command may include a code generated or executed by a compiler or an interpreter. The machine-readable storage medium may be provided in the form of a non-transitory storage medium. Wherein, the "non-transitory" storage medium does not include a signal and is tangible, but may not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed online in the form of a machine-readable storage medium (e.g., compact disc read only memory (CD-ROM)), or via an application store (e.g., PlayStore™). If distributed online, at least part of the computer program product may be at least temporarily stored or temporarily generated in the machine-readable storage medium, such as memory of the manufacturer's server, a server of the application store, or a relay server.

Each component (e.g., a module or a program) according to various embodiments may include a single entity or multiple entities, and some of the above-described corresponding sub components may be omitted, or other sub components may be further included in various embodiments. Alternatively or additionally, some components (e.g., modules or programs) may be integrated into a single component, and may still perform a function performed by each of the corresponding components before the integration in the same or similar manner. According to various embodiments, operations performed by the module, the program, or another component may be carried out sequentially, in parallel, repeatedly, or heuristically, or at least some operations may be executed in a different order or omitted, or other operations may be added.

Various example embodiments illustrated and described in the disclosure and the drawings are merely examples provided for easily describing the technical matters according to the embodiments of the disclosure and to aid in understanding embodiments of the disclosure, and do not limit the scope of the disclosure. Therefore, it should be understood that all modifications or modified forms capable of being derived from the technical idea of the various example embodiments of the disclosure in addition to the embodiments disclosed herein are included in the scope of the various embodiments of the disclosure including the appended claims and their equivalents. It will also be understood that any of the embodiment(s) described herein may be used in conjunction with any other embodiment(s) described herein.

What is claimed is:

1. An electronic device comprising:

a communication circuit;

a display;

a speaker; and a controller electrically connected to the communication circuit, the display, and the speaker, wherein the controller is configured to:

control the display or the speaker to output a first guidance message in response to a selection input of a sensor ball registration mode;

identify identification information of a sensor ball included in a sensor ball-related message received through the communication circuit within a specified time;

control the display or the speaker to output a second guidance message related to changing movement of the sensor ball based on the specified time expiring; and based on the specified time expiring, perform control to register the sensor ball based on information corresponding to a harvest voltage of the sensor ball, wherein the harvest voltage of the sensor ball is included in at least one sensor ball-related message received through the communication circuit from the sensor ball and changes in response to the change in movement of the sensor ball, wherein the first guidance message includes instructions related to causing movement of the sensor ball and the second guidance message includes instructions related to stopping movement of the sensor ball.

2. The electronic device of claim 1, wherein the at least one sensor ball-related message comprises information corresponding to humidity sensed by the sensor ball.

3. The electronic device of claim 1, wherein the controller is configured to:

control the sensor ball to be registered based on a comparison between a harvest voltage stored in memory of the electronic device before the at least one sensor ball-related message is received and a value included in the identified information corresponding to the harvest voltage.

4. The electronic device of claim 1, wherein the controller is configured to: based on no sensor ball-related message being received from the sensor ball after the specified time has expired, perform control to register the sensor ball corresponding to the sensor ball-related message received within the specified time.

5. The electronic device of claim 1, wherein the controller is configured to:

identify information corresponding to the harvest voltage of the sensor ball and included in each of multiple sensor ball-related messages received through the communication circuit for the specified time; and based on the harvest voltage of the sensor ball being determined to be greater than a harvest voltage identified from a previous sensor ball-related message, perform control to register the sensor ball corresponding to the sensor ball-related message.

6. The electronic device of claim 1, wherein the sensor ball-related message is transmitted through an advertisement message of Bluetooth low energy (BLE).

7. The electronic device of claim 1, comprising an actuator, wherein the controller is configured to control operation of the actuator based on a harvest voltage information included in sensor ball-related messages received from the sensor ball.

8. The electronic device of claim 1, comprising an actuator, wherein the controller is configured to control operation of the actuator based on humidity sensed by the sensor ball included in sensor ball-related messages received from the sensor ball.

9. The electronic device of claim 1, wherein the controller is configured to:

identify information corresponding to the harvest voltage of the sensor ball; and based on the harvest voltage of the sensor ball being determined to be less than a previously identified harvest voltage, perform control to register the sensor ball corresponding to the sensor ball-related message, wherein the at least one sensor ball-related message is received after the specified time has expired.

10. An electronic device comprising:

a communication circuit;

a display;

an actuator;

a speaker; and a controller electrically connected to the communication circuit, the display, the actuator, and the speaker, wherein the controller is configured to:

control the actuator to be driven during a specified first operation interval;

identify identification information of a sensor ball included in a sensor ball-related message received through the communication circuit during the specified first operation interval;

control the actuator to be stopped during a specified first stop interval based on the specified first operation interval elapsing;

identify information corresponding to a harvest voltage of the sensor ball, wherein at least one sensor ball-related message is received through the communication circuit after the specified first stop interval has expired; and perform control to register, based on the information corresponding to the harvest voltage of the sensor ball being determined to be less than a previously identified harvest voltage, the sensor ball corresponding to the sensor ball-related message received during a specified time based on the specified first stop interval elapsing.

11. The electronic device of claim 10, wherein the at least one sensor ball-related message comprises information corresponding to humidity sensed by the sensor ball.

12. The electronic device of claim 10, wherein the controller is configured to control operation of the actuator based on humidity sensed by the sensor ball included in sensor ball-related messages received from the sensor ball.

13. A method for sensor ball registration by an electronic device, the method comprising:

outputting a first guidance message through a display or a speaker in response to a selection input of a sensor ball registration mode;

identifying identification information of a sensor ball included in a sensor ball-related message received through a communication circuit within a specified time;

outputting a second guidance message related to changing movement of the sensor ball through the display or the speaker based on the specified time expiring; and based on the specified time expiring, registering the sensor ball based on information corresponding to a harvest voltage of the sensor ball, wherein the harvest voltage of the sensor ball is included in at least one sensor ball-related message received through the communication circuit from the sensor ball and changes in response to the change in movement of the sensor ball, wherein the first guidance message includes instructions related to causing movement of the sensor ball and the second guidance message includes instructions related to stopping movement of the sensor ball.

14. The method of claim 13, wherein the at least one sensor ball-related message comprises information corresponding to humidity sensed by the sensor ball.

15. The method of claim 13, comprising:

identifying the information corresponding to the harvest voltage; and registering the sensor ball based on a comparison between a harvest voltage stored in a memory before the at least one sensor ball-related message is received and a value included in the identified information corresponding to the harvest voltage.

16. The method of claim 15, comprising registering, based on no sensor ball-related message being received from the sensor ball after the specified time has expired, the sensor ball corresponding to the sensor ball-related message received within the specified time.

17. A method for sensor ball registration by an electronic device, the method comprising:

outputting a first guidance message through a display or a speaker in response to a selection input of a sensor ball registration mode;

identifying identification information of a sensor ball included in a sensor ball-related message received through a communication circuit within a specified time;

outputting a second guidance message related to changing movement of the sensor ball through the display or the speaker based on the specified time expiring;

identifying information corresponding to a harvest voltage of the sensor ball; and based on the specified time expiring and based on the harvest voltage of the sensor ball being determined to be less than a previously identified harvest voltage, registering the sensor ball corresponding to the sensor ball-related message, wherein at least one sensor ball-related message includes information corresponding to the harvest voltage of the sensor ball and is received after the specified time has expired, and the harvest voltage of the sensor ball changes in response to the change in movement of the sensor ball.

18. An electronic device comprising:

a communication circuit;

a communication circuit;

a display;

a speaker; and a controller electrically connected to the communication circuit, the display, and the speaker, wherein the controller is configured to:

control the display or the speaker to output a first guidance message in response to a selection input of a sensor ball registration mode;

identify identification information of a sensor ball included in a sensor ball-related message received through the communication circuit within a specified time;

control the display or the speaker to output a second guidance message related to changing movement of the sensor ball based on the specified time expiring; and identify information corresponding to a harvest voltage of the sensor ball; and based on the specified time expiring and based on the harvest voltage of the sensor ball being determined to be less than a previously identified harvest voltage, perform control to register the sensor ball corresponding to the sensor ball-related message, wherein at least one sensor ball-related message includes information corresponding to the harvest voltage of the sensor ball and is received after the specified time has expired, and the harvest voltage of the sensor ball changes in response to the change in movement of the sensor ball.

19. The electronic device of claim 18, wherein the second guidance message includes instructions related to shaking the sensor ball.

* * * * *